US011298696B2

(12) United States Patent
Chen et al.

(10) Patent No.: US 11,298,696 B2
(45) Date of Patent: Apr. 12, 2022

(54) REACTION CASSETTE AND ASSAY DEVICE

(71) Applicant: APEX BIOTECHNOLOGY CORP., Hsinchu (TW)

(72) Inventors: Sz Hau Chen, Taipei (TW); Ming Chang Hsu, Hsinchu (TW); Yu-Ju Lu, Hsinchu (TW); Chia-Jung Wang, Hsinchu (TW); Jui-Pin Hrian, Hsinchu (TW)

(73) Assignee: APEX BIOTECHNOLOGY CORP., Hsinchu (TW)

( * ) Notice: Subject to any disclaimer, the term of this patent is extended or adjusted under 35 U.S.C. 154(b) by 247 days.

(21) Appl. No.: 16/668,396

(22) Filed: Oct. 30, 2019

(65) Prior Publication Data

US 2020/0147607 A1 May 14, 2020

Related U.S. Application Data

(60) Provisional application No. 62/757,248, filed on Nov. 8, 2018.

(51) Int. Cl.
*B01L 3/00* (2006.01)

(52) U.S. Cl.
CPC ..... *B01L 3/502707* (2013.01); *B01L 3/50273* (2013.01); *B01L 3/502746* (2013.01); (Continued)

(58) Field of Classification Search
CPC ..... B01L 2200/0621; B01L 2300/0816; B01L 2300/0858; B01L 2300/087; B01L 2300/0874; B01L 2300/089; B01L 2400/0457; B01L 2400/086; B01L 3/5023; B01L 3/502707; B01L 3/50273; (Continued)

(56) References Cited

U.S. PATENT DOCUMENTS 8,617,490 B2 12/2013 Teng et al.
8,802,036 B2 8/2014 Chen et al.
(Continued)

FOREIGN PATENT DOCUMENTS

CN 102072951 A 5/2011
WO WO-2017005123 A1 * 1/2017 ..... G01N 33/53
WO WO-2018153953 A1 * 8/2018 ..... B01L 3/502715

OTHER PUBLICATIONS

Office Action and Search Report issued in corresponding TIPO application No. TW108139302 dated Jan. 13, 2021.

*Primary Examiner* — Jennifer Wecker
(74) *Attorney, Agent, or Firm* — Muncy, Geissler, Olds & Lowe, P.C.

(57) ABSTRACT

The present disclosure provides a reaction cassette for biochemical test. The reaction cassette includes a structural wall, a first flow guiding member and an obstacle member. The structural wall defines a reaction region and a channel region, wherein the reaction region is connected to the channel region. The first flow guiding member is disposed in the channel region, and a first angle between the structural wall and the first flow guiding member ranges between 0 and 60 degrees. The obstacle member is disposed on the structural wall, and a second angle between the obstacle member and the structural wall is greater than 90 degrees. The present disclosure further provides an assay device including said reaction assay for biochemical test.

15 Claims, 16 Drawing Sheets

(52) U.S. Cl.
CPC ... *B01L 3/502753* (2013.01); *B01L 3/502761* (2013.01); *B01L 2300/087* (2013.01); *B01L 2300/089* (2013.01); *B01L 2300/0858* (2013.01); *B01L 2300/0874* (2013.01); *B01L 2400/0457* (2013.01); *B01L 2400/086* (2013.01)

(58) Field of Classification Search
CPC ..... B01L 3/502746; B01L 3/502753; B01L 3/502761
See application file for complete search history.

(56) References Cited

U.S. PATENT DOCUMENTS

| | | | | |
|---|---|---|---|---|
| 9,968,929 | B2 | 5/2018 | Chen et al. | |
| 2018/0193842 | A1 * | 7/2018 | Liu ..... | G01N 33/53 |

* cited by examiner

REACTION CASSETTE AND ASSAY DEVICE

PRIORITY CLAIM AND CROSS-REFERENCE

This application claims the priority benefit of U.S. provisional patent application No. 62/757,248, filed on Nov. 8, 2018. The entirety of the above-mentioned patent application is hereby incorporated by reference herein and made a part of this specification.

FIELD OF THE INVENTION

The present invention relates to a reaction cassette and an assay device applied for medical measurement, and more particularly to a reaction cassette including a flow guiding member and an assay device.

DESCRIPTION OF THE BACKGROUND

In vitro medical measurement plays an essential role in modern medical industry. Medical professionals can observe changes in critical physiological signals or test indicators of a patient by qualitatively and quantitatively measuring changes in body fluids in the human body, so as to quickly diagnose conditions and provide indicator information for treatment. Current biochemical assay cassettes greatly involve functional tests associated with blood and urine, such as tests for blood cells, glycated hemoglobin, urine protein and liver function. These biochemical assay cassettes feature advantages of having qualitative and quantitative analysis accuracy approximating that of large-scale biochemical analyzers used in medical institutions, relatively simple and safe operation procedures for medical staff, and quicker analysis results provided to tested individuals.

In commercial reaction cassettes, a design of using a specific rotation angle and/or force is mostly used to control the flow direction of a specimen, further achieving objects such as dissolving and mixing with reagents and signal detection. Thus, a reaction cassette needs to be provided with multiple reaction regions in response to steps or concentration measurement requirements, and a corresponding channel needs to be designed in between the reaction regions so as to allow the flow of a specimen. However, in commercial cassettes, in order to prevent a specimen from flowing to another reaction region before a previous mixing process of the specimen is not yet complete, the channel at the reaction regions is frequently configured as an arc structure or a protruding blocking structure provided at the end of the channel. Hence, before the next mixing step is performed, a large angle or a large torque is necessarily applied on the cassette in order to allow the specimen to pass through the arc or protruding blocking structure. However, such large angle or large torque likely causes splashing of the specimen or damage of biological properties (for example, a large torque can easily damage blood cells), resulting in issues of congestion and flow failure of the specimen.

This Discussion of the Background section is provided for background information only. The statements in this Discussion of the Background are not an admission that the subject matter disclosed in this section constitutes prior art to the present disclosure, and no part of this Discussion of the Background section may be used as an admission that any part of this application, including this Discussion of the Background section, constitutes prior art to the present disclosure.

SUMMARY

A reaction cassette for biochemical test provided by the present disclosure includes: a structural wall, defining a reaction region and a channel region, wherein the reaction region is connected to the channel region; a first flow guiding member, disposed in the channel region, wherein an angle between the structural wall and the first flow guiding member ranges between 0 and 80 degrees; and an obstacle member, disposed on the structural wall, wherein an angle between the obstacle member and the structural wall is greater than 90 degrees. The present disclosure further provides an assay device for biochemical test and including the foregoing reaction cassette.

In some embodiments, the first flow guiding member and the obstacle member are spaced by a vertical distance.

In some embodiments, the vertical distance ranges between 0.1 and 0.4 mm.

In some embodiments, the first flow guiding member and the structural wall are disposed separately.

In some embodiments, a length of the first flow guiding member is greater than 4 mm and less than the length of the channel region.

In some embodiments, the reaction cassette further includes a second flow guiding member disposed in the channel region, wherein an angle between the structural wall and the second flow guiding member ranges between 0 and 80 degrees.

In some embodiments, the first flow guiding member is separated from the first flow guiding member, and the extension direction of the second flow guiding member is different from the extension direction of the first flow guiding member.

In some embodiments, the second flow guiding member and the first flow guiding member are disposed separately and parallel to each other.

An assay device for biochemical test further provided by the present disclosure includes a reaction cassette, a storage member and a sampling member. The reaction cassette is for a specimen to flow therein, and includes: a housing; a structural wall, disposed in the housing, defining a reaction region and a channel region, wherein the reaction region is connected to the channel region and the channel region extends along a first direction; a flow guiding member, disposed in the channel region; and an obstacle member, disposed on the structural wall and protruding toward the direction of the channel region. The storage member is for accommodating the specimen, and enables the specimen to flow into the reaction cassette to undergo a reaction. The sampling member is for absorbing the reacted specimen from the reaction cassette.

In some embodiments, the housing is a square in shape, and the first direction is parallel to one side of the housing.

In some embodiments, the flow guiding member is a protruding structure protruding from the housing toward the channel region or protruding from an internal space of the reaction cassette.

In some embodiments, the flow guiding member is a groove structure recessed from a surface of the housing facing the channel region.

In some embodiments, the housing includes a front cover and a back cover, and the flow guiding member includes a first part disposed on the front cover and a second part disposed on the back cover.

In some embodiments, the first part and the second part are opposite to each other, and between the first part and the second part is at least a gap for allowing the specimen to flow through.

In some embodiments, the structural wall is parallel to one side of the housing, the obstacle member is provided on the back cover, and the obstacle member is configured to define an assembly slot corresponding to an assembly bolt of the front cover.

The reaction cassette of the present disclosure includes a flow guiding member and an obstacle member located in the channel region, and the structural configuration combining the flow guiding member and the obstacle member helps a specimen to flow from the reaction region toward a detection region or other regions, and is capable of reducing a rotation angle that is applied to the reaction cassette for enabling the specimen to flow out, hence mitigating the issues of torrents or splashing of the specimen caused by rotation and effectively preventing the specimen from flowing as a result of rotation to other regions. According to test results of some embodiments of the present disclosure, the reaction cassette of the present disclosure is, compared to a reaction cassette without the flow guiding member and the obstacle member, capable of reducing the rotation angle by about 10 to 20 degrees.

The foregoing has outlined rather broadly the features and technical advantages of the present disclosure in order that the detailed description of the disclosure that follows may be better understood. Additional features and technical advantages of the disclosure are described hereinafter, and form the subject of the claims of the disclosure. It should be appreciated by those skilled in the art that the concepts and specific embodiments disclosed may be utilized as a basis for modifying or designing other structures, or processes, for carrying out the purposes of the present disclosure. It should also be realized by those skilled in the art that such equivalent constructions do not depart from the spirit or scope of the disclosure as set forth in the appended claims.

BRIEF DESCRIPTION OF THE DRAWINGS

A more complete understanding of the present disclosure may be derived by referring to the detailed description and claims. The disclosure should also be understood to be coupled to the figures' reference numbers, which refer to similar elements throughout the description.

DETAILED DESCRIPTION OF THE EMBODIMENTS

Figure 1:
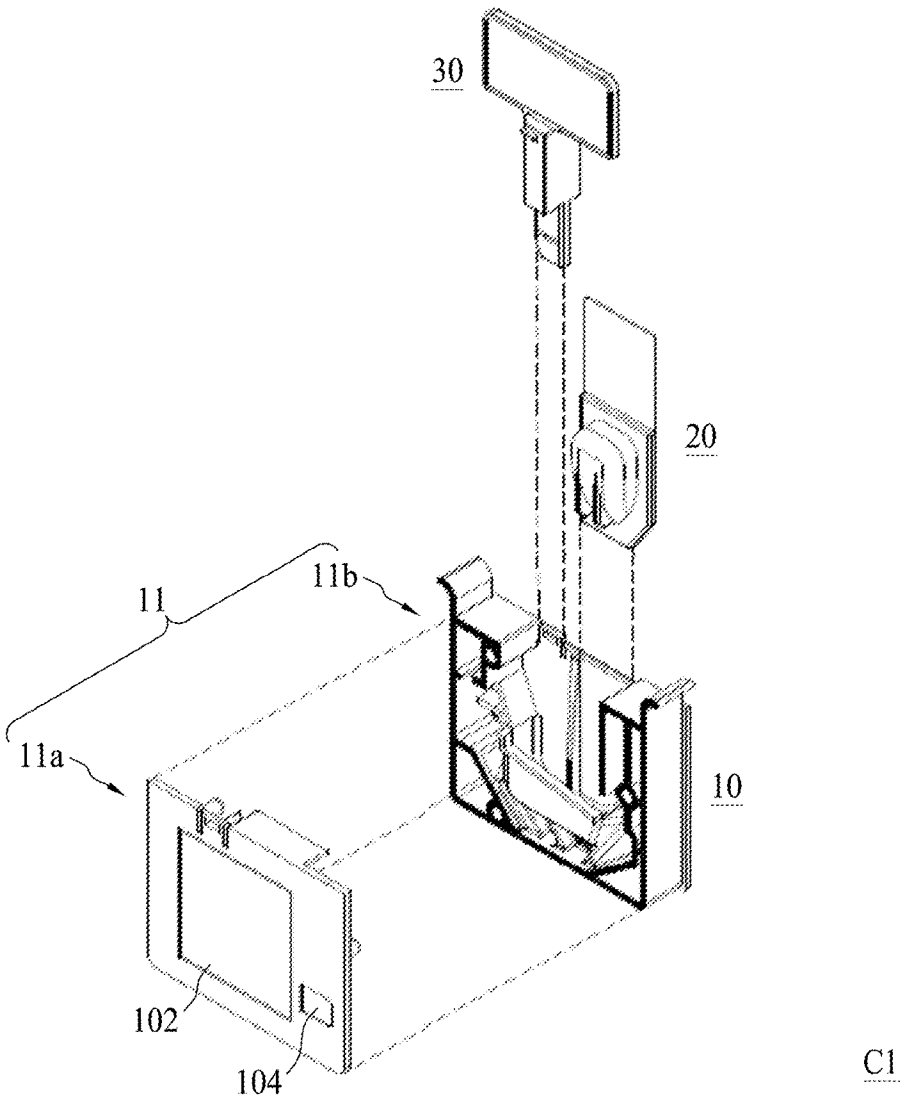
FIG. 1 is a schematic diagram of an assay device depicted according to some embodiments of the present disclosure.

Implementation forms of the present disclosure are discussed in detail below. However, it should be understood that, the embodiments provide various applicable inventive concepts implementable in various specific environments. The specific embodiments discussed are merely for explaining specific means and modes for manufacturing and utilization embodiments, and are not to be construed as limitations to the scope of the present disclosure.

In the drawings and illustrative embodiments, the same numerals and symbols are configured to represent the same elements. The exemplary embodiments shown in the drawings are to be referred in detail. When possible, the same numerals and symbols are used in the drawings and description to represent the same or similar elements. In the drawings, for clarity and convenience, shape and thickness can be emphasized. The description is given particularly for a part formed according to a device of the present invention or elements directly matching therewith. It should be understood that, elements that are not specifically shown or described can be implemented in various forms. Throughout the description, the reference of "some embodiments" or "embodiments" implies that the combination of specific features, structures or properties described in the embodiment is included in at least one embodiment. Therefore, throughout the description, the expressions "in some embodiments" or "in embodiments" recited in various parts do not necessarily refer to the same embodiment. Further, the specific features, structures or properties can be combined in any appropriate manner in one or more embodiments.

In the drawings, the same numerals and symbols are configured to indicate the same or similar elements in the drawings, and depict and describe the illustrative embodiments of the present invention. The drawings are not necessarily drawn to actual scales, and are emphasized and/or simplified in certain situations and configured to explain the objects. Based on the descriptive embodiments of the present invention below, a person of ordinary skill in the art can understand numerous possible applications and variations of the present invention.

Unless otherwise defined, all terms (including technical and scientific terms) used herein have the same meanings as those usually understood by a person of ordinary skill in the technical field of the embodiments of the present disclosure. It should be understood that, the terms defined in general dictionaries should be interpreted as having meanings consistent with those of related fields and the context of the present disclosure, and should not be understood as overly formal meanings, unless otherwise clearly defined herein.

Further, multiple embodiments of the present disclosure are provided below as examples for explaining core values of the present disclosure, and are not to be construed as limitations to the scope of the present disclosure. For clear illustration and understanding convenience, the same or similar functions or elements in different embodiments of the disclosure are not repeatedly described or denoted in the drawings. Moreover, given no conflicts are incurred, new embodiments derived from combination or substitution of different elements or technical features in different embodiments still fall within the protection scope of the present disclosure.

Figure 2:
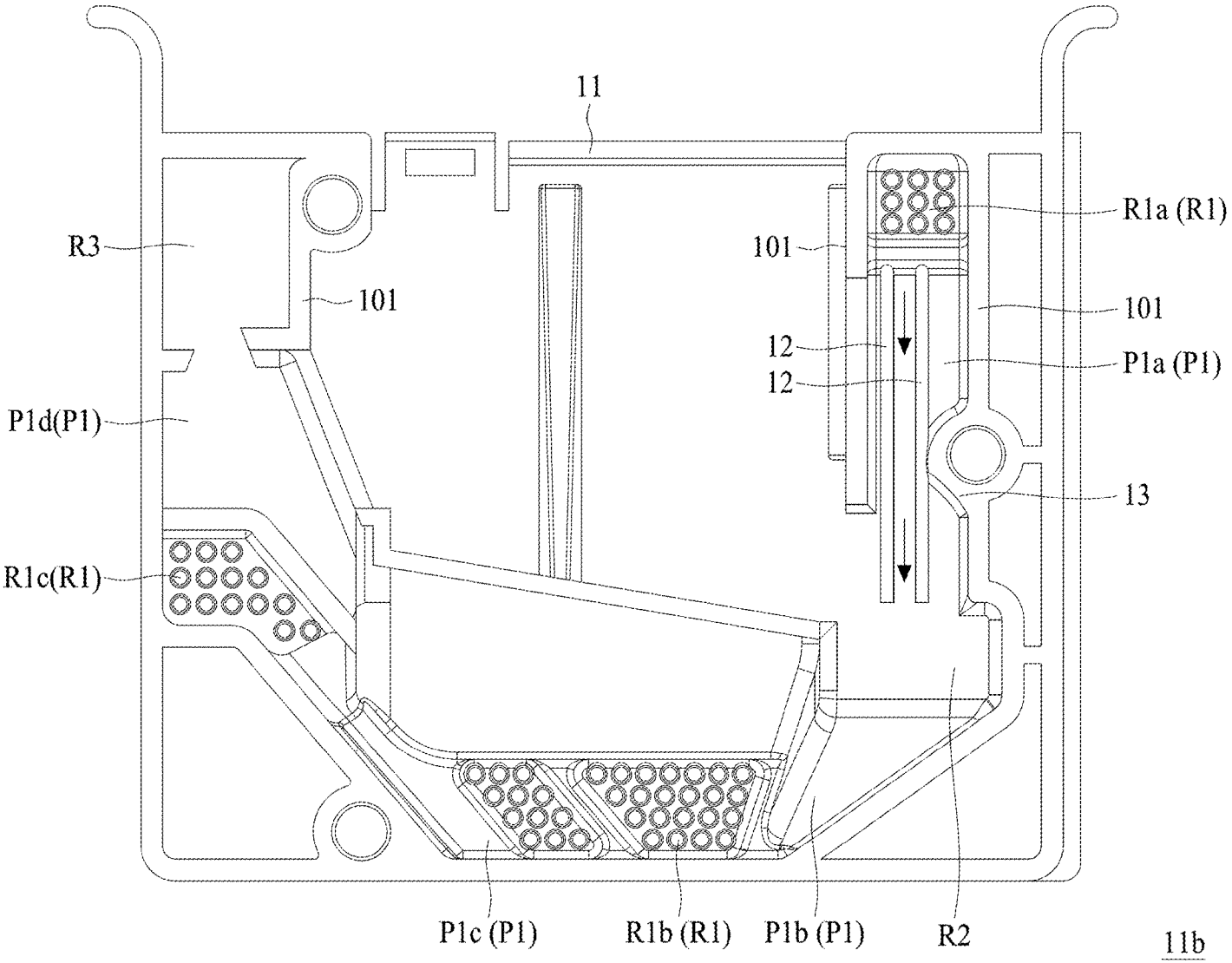
FIG. 2 is a schematic diagram of an internal structure of a reaction cassette depicted according to some embodiments of the present disclosure.

FIG. 1 shows a schematic diagram of an assay device C1 depicted according to some embodiments of the present disclosure. The assay device C1 includes a reaction cassette 10, a storage member 20 and a sampling member 30. The reaction cassette 10 includes a housing 11 having a front cover 11*a* and a back cover 11*b*. FIG. 2 shows a schematic diagram of the back cover 11*b* depicted according to the embodiment in FIG. 1 for illustrating the internal structure of the reaction cassette 10 of the present disclosure.

Referring to FIG. 1 and FIG. 2, the storage member 20 is for accommodating a buffer solution or a reagent, and the sampling member 30 is for accommodating a specimen. Upon assembly of the reaction cassette 10, the storage member 20 and the sampling member 30, the buffer solution on the storage member 20 is released. The buffer solution washes the sampling member 30 and becomes mixed with a sample to form a specimen, which then flows into the reaction cassette 10 to undergo reaction. The structural details of the storage member 20 are not limited by the present disclosure. In some embodiments, the storage member 20 is independent from the sampling member 30 and the reaction cassette 10. In some embodiments, the storage member 20 and the sampling member 30 are an integral or monolithic structure. In some embodiments, the storage member 20 and the front cover 11*a* or the back cover 11*b* of the reaction cassette 10 are one integral structure. The reaction cassette 10 is for the specimen to flow therein, and the internal space thereof includes at least one absorption region R3, at least one detection region R2, multiple reaction regions R1, and multiple channel regions P1 connecting the regions. Upon assembly of the reaction cassette 10, the storage member 20 and the sampling member 30, the specimen flows into the reaction cassette 10, and is caused to flow into different regions by means of a rotation angle of the reaction cassette 10 so as to undergo reaction.

The specimen flows into one or more reaction regions R1 through one or more channel regions R1 to undergo reaction, and the reacted specimen flows into the absorption region R3 of the reaction cassette 10. The absorption region R3 is a region defined by a hollow and non-closed structural wall 101 having an opening, wherein the opening is located at, for example, below the absorption region R3, so as to allow an absorption material to absorb the reacted specimen. The absorption region R3 can include the absorption material for absorbing the reacted specimen. The absorption material can be a porous material or an absorptive material, such as cotton, sponge, filter paper and algae.

The detection region R2 is for detecting a concentration value of an object under analysis in the specimen, and the part of the reaction cassette 10 defining the detection region R2 is made of a transparent or semi-transparent material for light to pass through, so as to perform detection of an object under analysis by means of optical measurement. In some embodiments, the reaction cassette 10 is made from casting an optical scale transparent material by means of injection molding. In some embodiments, to reduce interference of light, the surface of the reaction cassette 10 is processed by matte treatment. In some embodiments, the reaction cassette 10 further includes a barcode label 102 attached on the matte surface of the front cover 11*a* of the reaction cassette 10, and a light transmissive window 104 corresponding to the detection region R2. Upon insertion of the storage member 20 into the reaction cassette 10, the specimen enters the reaction cassette 10, and an optical measurement procedure can be performed by using the light transmissive window 104 provided at the front cover 10*a* and the detection region R2 provided at the back cover 11*b*.

The reaction region R1, which may be multiple in quantity, includes multiple reactants for reacting with the specimen, and individually has a function of accommodating the specimen for mixing and reacting. As shown in FIG. 2, the reaction region R1 includes a first reaction region R1*a*, a second reaction region R2*a* and a third reaction region R3*a*; however, the present disclosure is not limited to such example. In some embodiments, a part of the reaction region R1 can be provided with a bump array (for example, the arrays of circles in the first reaction region R1*a*, the second reaction region R2*a* and the third reaction region R3*a* in FIG. 2) for promoting reaction efficiency. As the specimen and a test agent flow to the reaction region R1, disordered flows are resulted in the specimen due to the presence of the bumps in the reaction region R1, thus increasing the reaction rate among test agents and improving measurement accuracy.

The channel region P1 limits the flow of the specimen, and guides the specimen to flow to the reaction region R1 to undergo reaction or guides the specimen to flow from the reaction region R1 to other regions. The channel region P1 can be multiple in quantity. In the embodiment shown in FIG. 1 and FIG. 2, the channel region P1 includes a first channel region P1*a*, a second channel region P1*b*, a third channel region P1*c* and a fourth channel region P1*d*, causing the specimen to flow back and forth among the reaction regions R1, the detection region R2 or the absorption region R3. As the embodiment shown in FIG. 1 and FIG. 2, the reaction cassette 10 includes a first channel region P1*a*, the second channel region P1*b* and the third channel region P1*c*, and a first reaction region R1*a*, a second reaction region R1*b* and a third reaction region R1*c*. The first channel region P1*a* is connected to the first reaction region R1*a* and the detection region R2, the second channel region R1*b* is connected to the detection region R2 and the second reaction region R1*b*, the third channel region R1*c* is connected to the second reaction region R1*b* and the third reaction region R1*c*, and the fourth channel region P1*d* is connected to the third reaction region R1*c* and the absorption region R3. It should be noted that, the channel region P1 in the present disclosure is for connecting the regions in the reaction cassette 10 in series, and providing space needed for flowing of the specimen. However, the present disclosure does not limit the configuration form of the channel region P1, and given that channel region P1 allows the specimen to flow in different regions, the channel region can be a plane or a sloped plane or can have round corners.

To allow the specimen to react according to a design in the reaction cassette 10, the reaction cassette 10 includes multiple structural walls 101, which are disposed in the housing 11 and are for defining multiple regions at the interior of the reaction cassette 10. As shown in FIG. 2, the structural walls 101 define the detection region R2, the absorption region R3, multiple reaction regions R1 and multiple channel regions P1. Further, to allow the specimen to flow smoothly, no structural wall 101 is provided between the channel region P1 and the reaction region R1 and/or the detection region R3 connected thereto.

In some embodiments, the sizes of the channel region P1 of the reaction cassette 10 can be different. As the channel region. P1 gets smaller, for example, the second channel region P1*b* and the third channel region P1*c* shown in FIG. 2, the shear stress applied by the structural wall 101 upon the specimen becomes larger. However, as the channel region P1 gets larger, for example, the size of the first channel region P1*a* shown in FIG. 2 is larger than those of the second channel region P1*b* and the third channel region P1*c*, the shear stress applied by the structural wall 101 upon the specimen becomes relatively smaller, and thus the reaction cassette 10 needs to be provided with a larger rotation angle in order to allow the specimen to completely flow from the first reaction region R1*a* to the detection region R2 or to completely flow from the detection region R2 to the first reaction region R1*a*. However, torrents or splashing of the specimen to other regions can be more likely generated as the rotation angle of the reaction cassette 10 increases. To overcome this issue, for a larger channel region P1 (for example, the first channel region P1*a* in this embodiment), the reaction cassette 10 of the present disclosure further includes a flow guiding member 12 and an obstacle member 13 disposed therein.

As shown in FIG. 2, the flow guiding member 12 is disposed on the housing 11 and is located in the first channel region P1*a*, and an angle between the flow direction of the specimen and the first reaction region R1*a* ranges between 0 and 80 degrees, wherein 0 degree indicates that the flow guiding member 12 is parallel to the flow direction of the specimen. In some embodiments, an angle between the flow direction of the specimen and the first reaction region R1*a* ranges between 0 and 60 degrees. The flow direction of the specimen is an overall flow direction of the specimen between the first reaction region R1*a* and the detection region R2. Taking FIG. 2 for example, the flow direction of the specimen is represented by the arrows in between the flow guiding member 12, and the flow guiding member 12 is parallel to the flow direction of the specimen. It should be noted that, liquid does not have a fixed form and different parts of liquid can have multiple different flow directions; for example, a part of the specimen can flow toward the structural wall 101 due to rotation, and a part of the specimen can flow toward a direction away from the structural wall 101 after impacting with the structural wall 101 due to rotation. For better illustration and understanding, the term "the flow direction of a specimen" in the present disclosure refers to an overall flow direction of a specimen, and individual flow directions of different parts are not discussed. In some embodiments, the flow direction of the specimen can be an extension direction of the channel region P1. In some embodiments, the angle between the flow guiding member 12 and the structural wall 101 ranges between 0 and 80 degrees, wherein 0 degree indicates that the flow guiding member 12 is parallel to the structural wall 101. In some embodiments, the angle between the flow guiding member 12 and the structural wall 101 ranges between 0 and 60 degrees. In some embodiments, an angle between the flow guiding member 12 and the extension direction of the first channel region P1*a* ranges between 0 and 80 degrees, wherein 0 degrees indicates that the flow guiding member 12 is parallel to the extension direction of the first channel region P1*a*. In some embodiments, the angle between the flow guiding member 12 and the extension direction of the first channel region P1*a* ranges between 0 and 60 degrees. In some embodiments, to avoid residue of a specimen, the flow guiding member 12 is configured to be separated from the structural wall 101, so as to reduce the number of narrow gaps between elements that hinder the specimen from flowing out. In the embodiment in FIG. 1 and FIG. 2, the extension direction of the flow guiding member 12 is parallel to or substantially parallel to the flow direction of the specimen, which helps the specimen to flow from the first reaction region R1*a* toward the detection region R2 or to flow from the detection region R2 toward the first reaction region R1*a*.

In some embodiments, as shown in FIG. 2, the flow guiding member 12 is a strip-like protruding structure, and protrudes from the housing 11 towards an internal space of the reaction cassette 10. In some embodiments, the flow guiding member 12 is a strip-like groove structure, and is recessed from the surface of the housing 11 facing the internal space of the reaction cassette 10 toward the inside of the housing 11. In an embodiment where the flow guiding member 12 is a protruding structure, the flow guiding member 12 can be provided on one or both of the front cover 11*a* and the back cover 11*b* of the housing 11. Further, the height of the flow guiding member 12 protruding from the housing 11 is not limited, given that the protruding height is less than a distance between the front cover 11*a* and the back cover 11*b* after assembly of the two. When the flow guiding member 12 is provided on the front cover 11*a*, the flow guiding member 12 after assembly is not sealed with the back cover 11*b*; when the flow guiding member 12 is provided on the back cover 11*b*, the flow guiding member 12 after assembly is not sealed with the front cover 11*a*; when the flow guiding member 12 is provided on both the front cover 11*a* and the back cover 11*b*, the flow guiding members 12 after assembly have a gap in between or are not sealed with each other, thus allowing the specimen to smoothly pass through. In an embodiment where the flow guiding member 12 is a groove structure, the depth of the flow guiding member 12 recessed from the surface of the housing 11 does not exceed the thickness of the housing 11.

As shown in FIG. 2, the obstacle member 13 is disposed on the structural wall 101 and in the first channel region P1*a*, and protrudes from the structural wall 101 toward the direction of the interior of the first channel region P1*a*, or protrudes from the structural wall 101 toward the direction of the flow guiding member 12. An angle formed between the obstacle member 13 and the structural wall 101 is greater than 90 degrees so as to provide the flow direction of the specimen with dividing forces of different directions, which help the specimen undergoing reaction to be less likely to be splashed to other regions due to shaking of the reaction cassette 10, and further help a part of the specimen to slide along with another part of the specimen to promote the specimen to flow from the first reaction region R1*a* to the detection region R2 (with associated details to be given shortly in the following paragraphs). Because the channel region. P1 defined by the structural wall 101 determines the flow direction of the specimen, in some embodiments, the extension direction of the structural wall 101 is substantially the same as the flow direction of the specimen, or is substantially the same as the extension direction of the channel region P1. Further, although the housing 11 is square in shape and the extension directions of both the structural wall 101 and the first channel region P1*a* are parallel to one side of the housing 11 in the embodiment shown in FIG. 2, the present disclosure is not limited to such example. The housing 11 can be other geometrical shapes, and shapes and extension directions of the structural wall 101 and the first channel region P1*a* can be adjusted and configured according to different embodiments or internal spaces of different housings 11.

It is known from the above description that, the structural configuration combining the flow guiding member 12 and the obstacle member 13 helps the specimen flow out from the first reaction region R1*a*, and is capable of reducing the rotation angle of the reaction cassette 10, hence mitigating the issue of torrents or splashing of the specimen caused by rotation. According to test results of some embodiments of the present disclosure, the reaction cassette 10 of the present disclosure is, compared to a reaction cassette without the flow guiding member 12 and the obstacle member 13, capable of reducing the rotation angle thereof by about 10 to 20 degrees.

Figure 3:
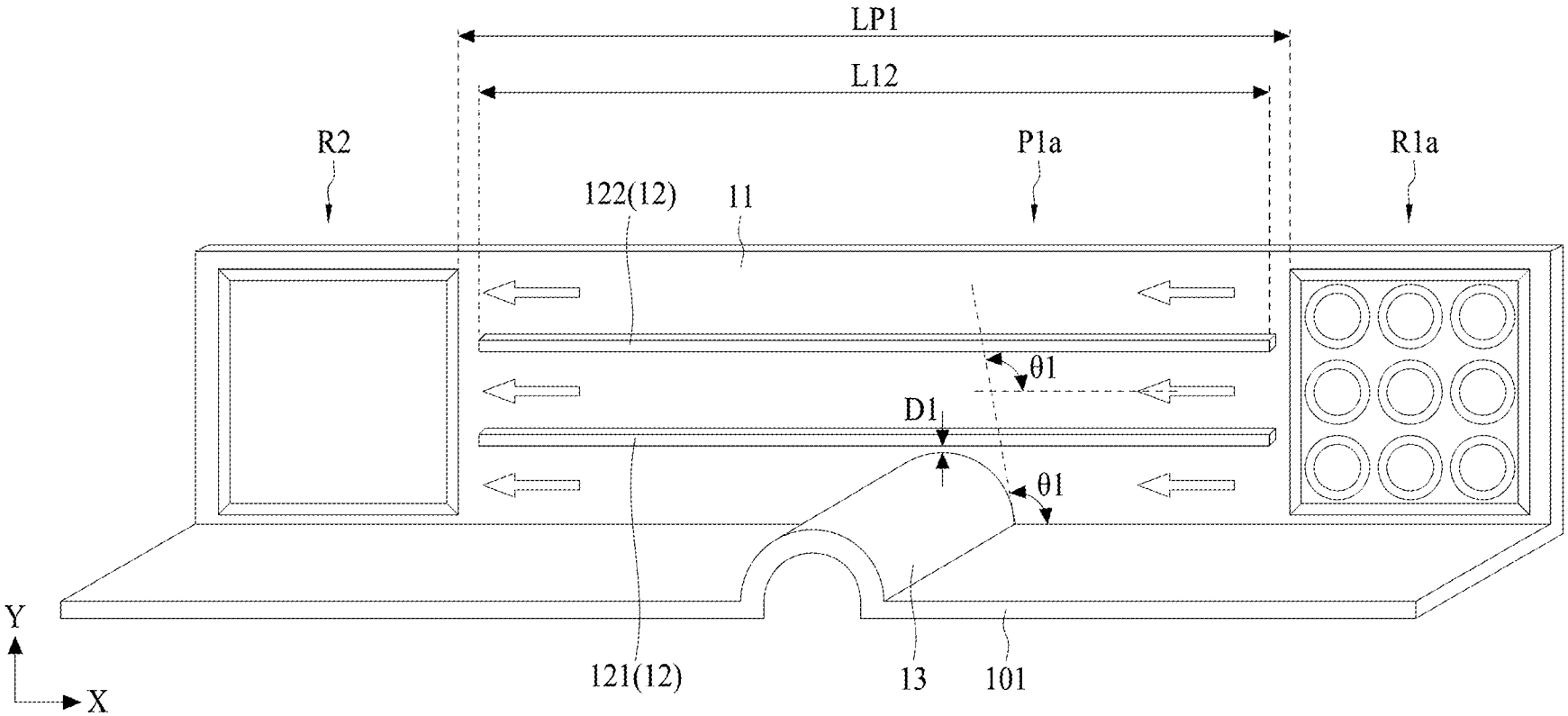
FIG. 3 is a partial schematic diagram of a reaction cassette depicted according to some embodiments of the present disclosure.
Figure 4:
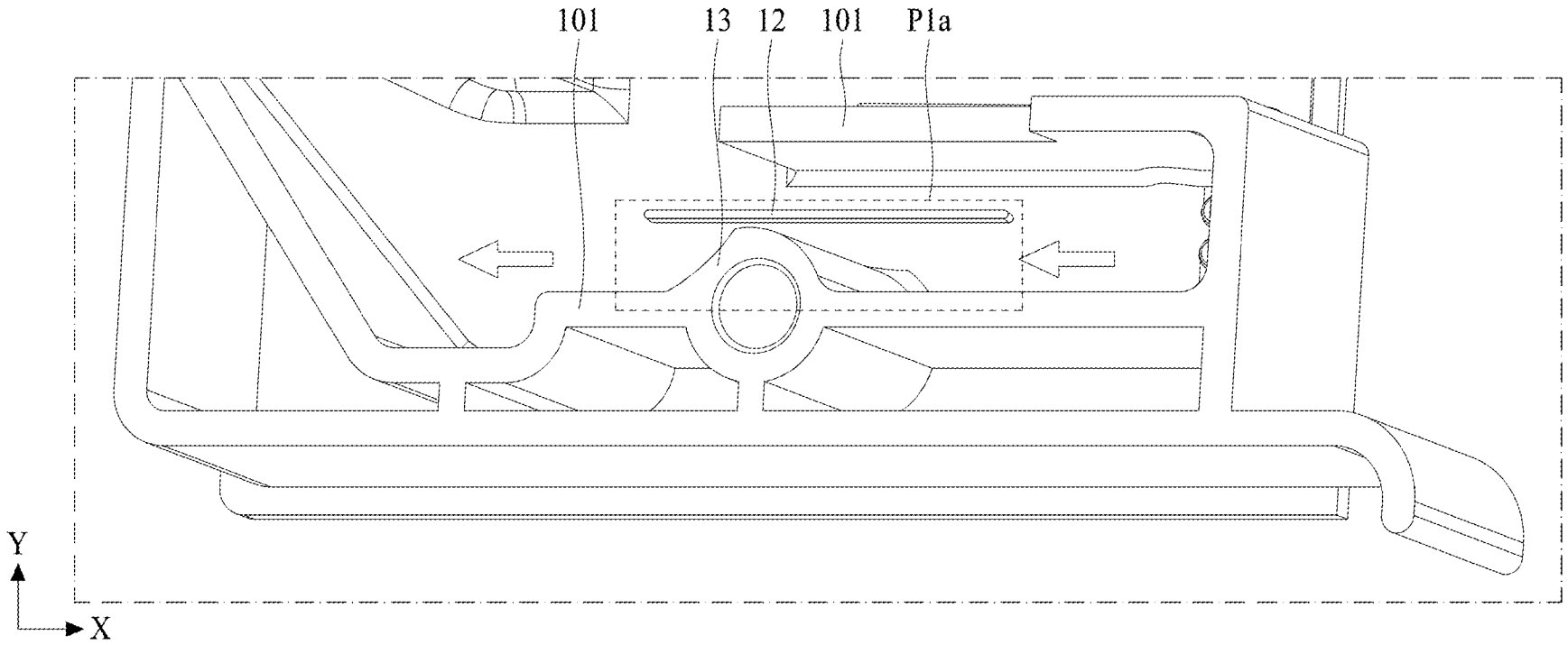
FIG. 4 to FIG. 8 are structural schematic diagrams of a channel region of a reaction cassette depicted according to different embodiments of the present disclosure.

To clearly explain the technical features of the present disclosure, FIG. 3 shows a partial schematic diagram of a reaction cassette 10 depicted according to some embodiments. In FIG. 3, only the first channel region P1*a* and associated structures are depicted; however, the present disclosure is not limited to the above. In some embodiments, upon flowing of the specimen in the reaction cassette 10 into the first reaction region R1*a*, the specimen is mixed and reacts with a dry reagent in the first reaction region R1*a*. Having undergone reaction in the first region R1*a*, the specimen flows from the first reaction region R1*a* through the first channel region P1*a* to the detection region R2, with the flow direction of the specimen being indicated as the hollow arrows in FIG. 3. As shown in FIG. 3, in some embodiments, the structural wall 101 extends along a connection direction of the first reaction region R1*a* and the first channel region P1*a*, that is, the structural wall 101 extends along the X direction in FIG. 3; in other words, the flow direction of the specimen is parallel to the structural wall 101. It should be noted that, as previously stated, the term "the flow direction of a specimen" refers to a macroscopic aspect that, the overall flow direction of the specimen flowing from the first reaction region R1*a* to the detection region R2 is parallel to the structural wall 101. However, in practice, the flow direction of the specimen changes according to the rotation angle of the reaction cassette 10. Thus, during the process of the specimen flowing in the first channel region P1*a*, a progressing direction of the specimen at a single time point may not be parallel to the structural wall 101.

The obstacle member 13 is disposed on the structural wall 101 and protrudes toward the direction of the flow guiding member 12. The function of the obstacle member 13 is to provide the specimen with a force different from the flow direction of the specimen, so as to prompt the specimen located in the rotating reaction cassette 10 to smoothly flow from the first reaction region R1*a* to the detection region R2. Meanwhile, to avoid residue of the specimen in the channel region P1, an angle formed by the obstacle member 13 and the flow direction of the specimen is configured to be greater than 90 degrees. In the embodiment shown in FIG. 3, the obstacle member 13 is arc-shaped and an angle between the obstacle member 13 and the flow direction of the specimen is not constant depending on different portions of the obstacle member 13. As shown in FIG. 3, the minimum of the angle formed between the obstacle member 13 and the flow direction of the specimen occurs at a joint of the obstacle member 13 and the structural wall 101. As shown in FIG. 3, the angle θ1 of the angle formed at the joint of the obstacle member 13 and the structural wall 101 is greater than 90 degrees. Further, because the flow direction of the specimen in this embodiment is parallel to the structural wall 101, the angle θ1 of the angle between the obstacle member 13 and the flow direction of the specimen is also greater than 90 degrees. Given that the angle θ1 is greater than 90 degrees, the angle θ1 can be adjusted according to the viscosity of the specimen, and the shape of the obstacle member 13 is not limited herein.

In some embodiments of the present disclosure, the flow guiding member 12 and the structural wall 101 are provided separately, and the flow guiding member 12 can be in single or plural in quantity. In the embodiment shown in FIG. 3, the flow guiding member 12 is in a quantity of two, including a first flow guiding member 121 and a second flow guiding member 122. For illustration purposes, in the description of the present disclosure below, the numeral 12 represents multiple flow guiding members, and the numerals 121 and 122 represent different flow guiding members. In this embodiment, the flow guiding member 12 extends along the connection direction of the first reaction region R1*a* and the detection region R2; in other words, the extension direction of the flow guiding member 12 is the same as the extension direction of the first channel region P1*a* or the flow direction of the specimen. In some embodiments, the extension direction of the first channel region P1*a* defines the flow direction of the specimen in the first channel region P1*a*. In some embodiments, the extension direction of the flow guiding member 12 is the same as the extension direction of a part of the structural wall 101 defining the first reaction region R1*a* and the detection region R2.

In the embodiment shown in FIG. 3, the structural wall 101 extends along the X direction, and the first flow guiding member 121 and the second guiding member 122 are both configured to be parallel to the structural wall 101. In some embodiments, the flow guiding member 12 and the obstacle member 13 are separated, and the shortest vertical distance spacing the two ranges between 0.1 and 0.4 mm. Herein, the vertical distance is defined as the shortest distance between the two elements measured along the Y-axis direction. To achieve an efficient flow guiding effect for the specimen, in some embodiments, a length L12 of the flow guiding member 12 is greater than 4 mm and less and or equal to a length LP1 of the first channel region P1*a*. The length LP1 of the first channel region P1*a* is, for example, a linear distance between the first reaction region R1*a* and the detection region R2. However, the present disclosure is not limited to such example. A person skilled in the art could understand that, the length LP1 of the first channel region P1*a* can be differently defined according to different embodiments. In some embodiments, the length LP1 of the first channel region P1*a* can be defined as desired, given that the flow guiding member 12 is completely located within the range of the first channel region P1*a*.

FIG. 4 to FIG. 8 show structural schematic diagrams of the first channel region P1*a* of the reaction cassette 10 depicted according to different embodiment of the present disclosure. For illustration purposes, the structural wall 101 and the flow direction of the specimen in the embodiment shown in FIG. 4 to FIG. 8 are similar to those of the embodiment in FIG. 3; that is, the specimen flows from the first reaction region R1*a* on the right of the first channel region P1*a* to the detection region R2 on the left of the first channel region P1*a* (for clarity, the first reaction region R1*a* and the detection region R2 are not depicted in FIG. 4 to FIG. 8), and the flow direction of the specimen is parallel to the structural wall 101 and progresses or extends along the X direction. In the embodiment shown in FIG. 4, the first channel region P1*a* is provided with one single flow guiding member 12, and the flow guiding member 12 is parallel to the structural wall 101 disposed with the obstacle member 13 and extends along the extension direction of the first channel region P1*a* or the flow direction of the specimen. In other words, the angle between the flow guiding member 12 and the structural wall 101 or the flow direction of the specimen is 0 degree. It should be noted that, in practice, the flow direction of the specimen changes according to the rotation angle of the reaction cassette 10. Thus, even if the angle between the flow guiding member 12 and the structural wall 101 or the overall flow direction of the specimen is 0 degree, the progressing direction of the specimen flowing in the first channel region P1*a* at any single time point may not be parallel to the structural wall 101 (i.e., the angle between the flow guiding member 12 and the structural wall 101 or the flow direction of the specimen is not 0 degree).

Figure 5:
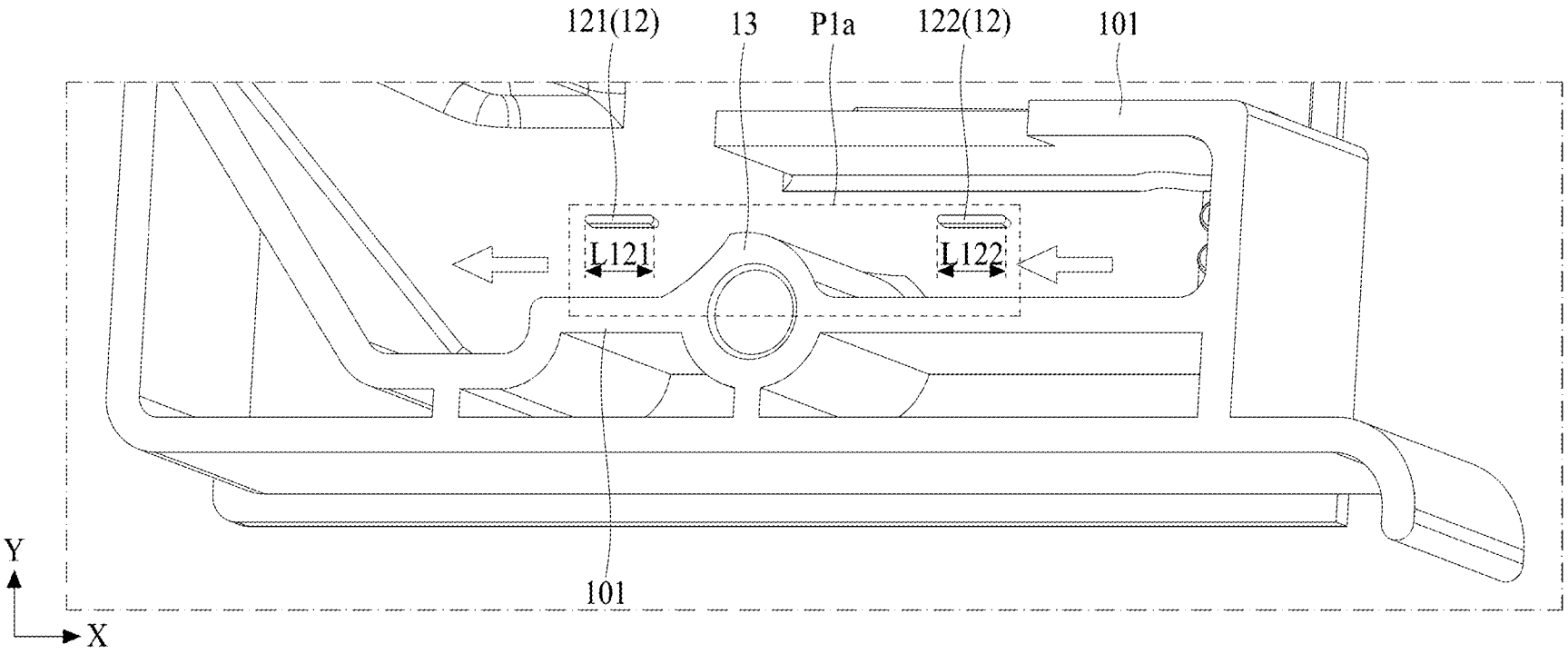

In the embodiment shown in FIG. 5, the first channel region P1*a* is provided with a plurality of flow guiding members 12, including a first flow guiding member 121 and a second flow guiding member 122. The first flow guiding member 121 and the second flow guiding member 122 are separated from each other and extend along the same direction. In this embodiment, the first flow guiding member 121 and the second flow guiding member 122 are respectively parallel to the structural wall 101 or the flow direction of the specimen, and the first flow guiding member 121 and the second flow guiding member 122 are respectively configured on two opposite sides of the obstacle member 13. In this embodiment, a length L121 of the first flow guiding member 121 and a length L122 of the second flow guiding member 122 are substantially the same, and the first flow guiding member 121 and the second flow guiding member 122 are provided on extension lines of each other. In other words, the vertical distance between the first flow guiding member 121 and the structural wall 101, and the vertical distance between the second flow guiding member 122 and the structural wall 101 are substantially the same. In FIG. 5, the dotted lines between the first flow guiding member 121 and the second flow guiding member 122 represent the extension lines of the first flow guiding member 121 and the second flow guiding member 122. However, the present disclosure is not limited to such example.

Figure 6:
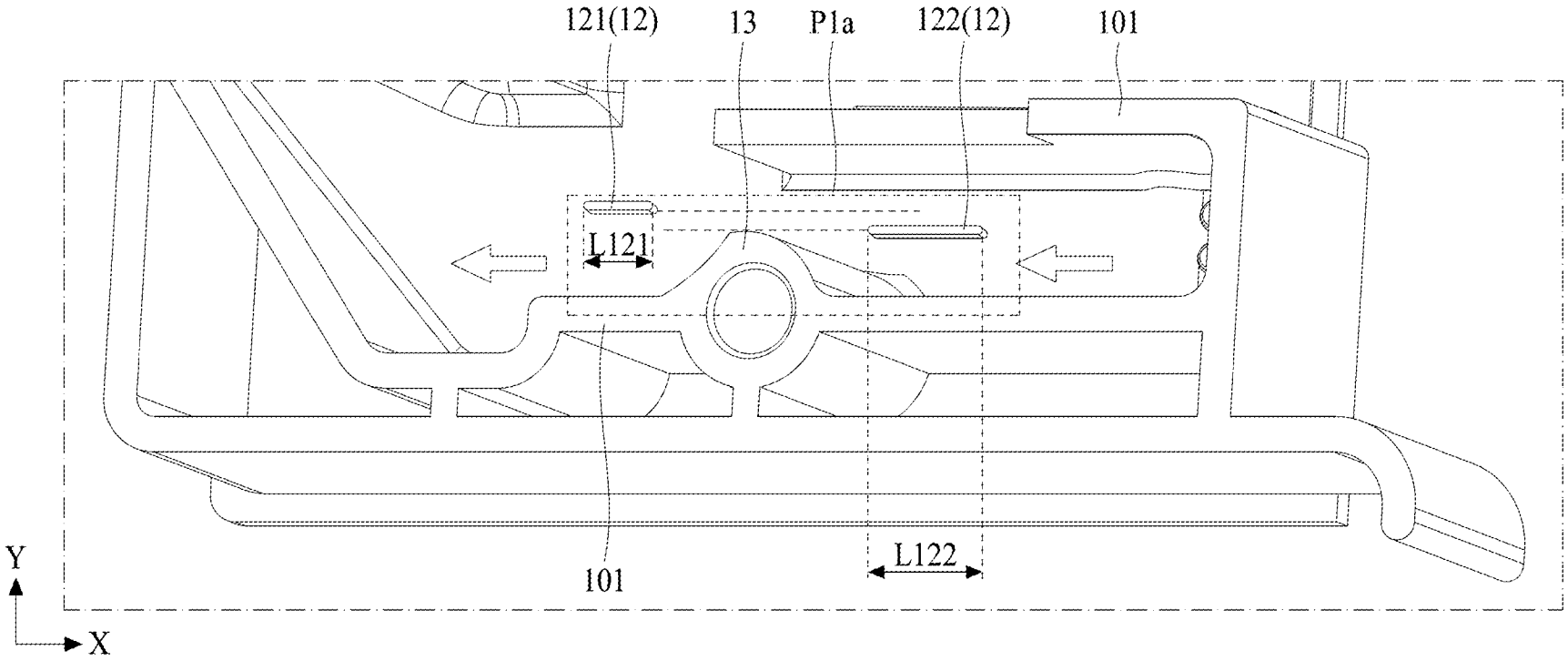

In the embodiment shown in FIG. 6, similar to the embodiment in FIG. 5, the flow guiding member 12 includes the first flow guiding member 121 and the second flow guiding member 122. The first flow guiding member 121 and the second flow guiding member 122 are substantially parallel to the structural wall 101 disposed with the obstacle member 13 or the flow direction of the specimen; however, the length L121 of the first flow guiding member 121 and the length L122 of the second flow guiding member 122 are different. In the embodiment shown in FIG. 6, the length L122 of the second flow guiding member 122 is greater than the length L121 of the first flow guiding member 121. Further, in this embodiment, the extension lines of the first flow guiding member 121 and the second flow guiding member 122 are different from each other and do not intersect with each other; that is, the first flow guiding member 121 and the second flow guiding member 122 are not parallel to each other. The extension lines of the first flow guiding member 121 and the second flow guiding member 122 in FIG. 6 are represented by dotted lines. However, the present disclosure is not limited to such example.

Figure 7:
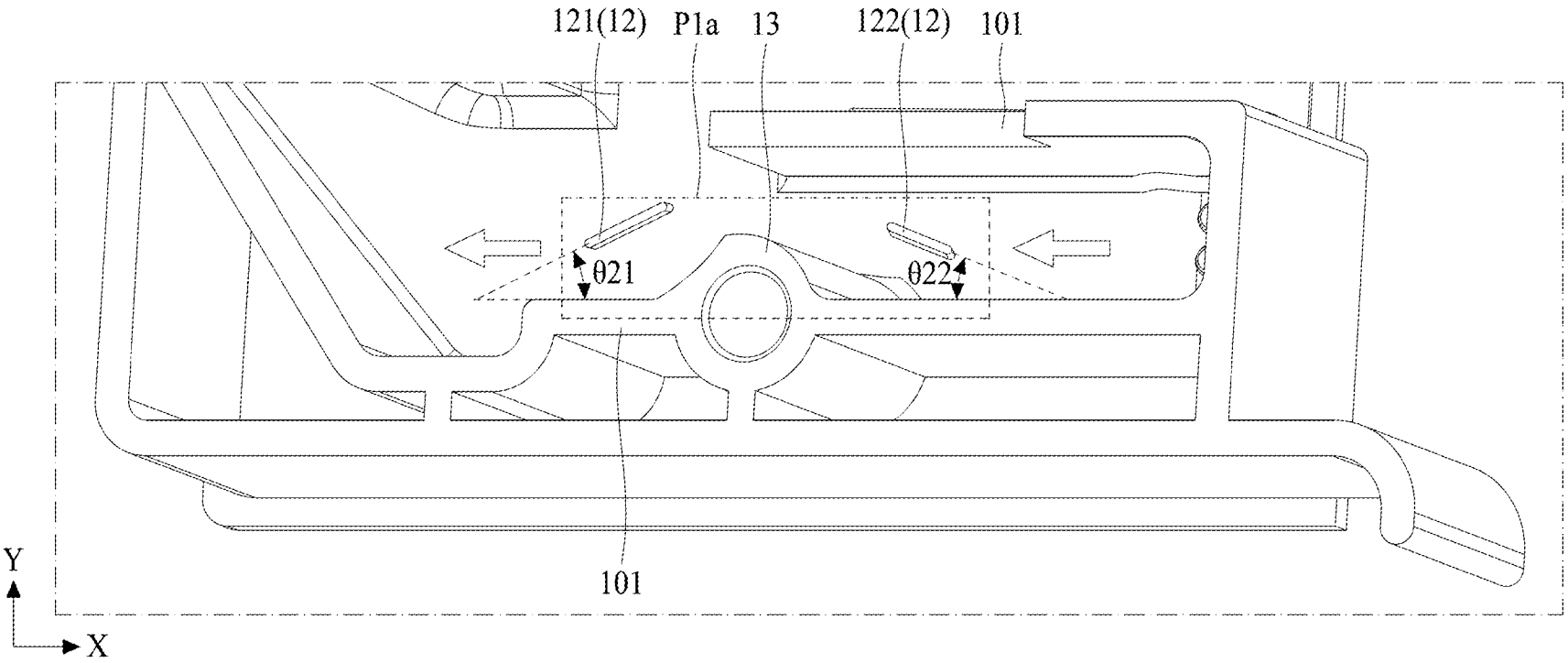
Figure 8:
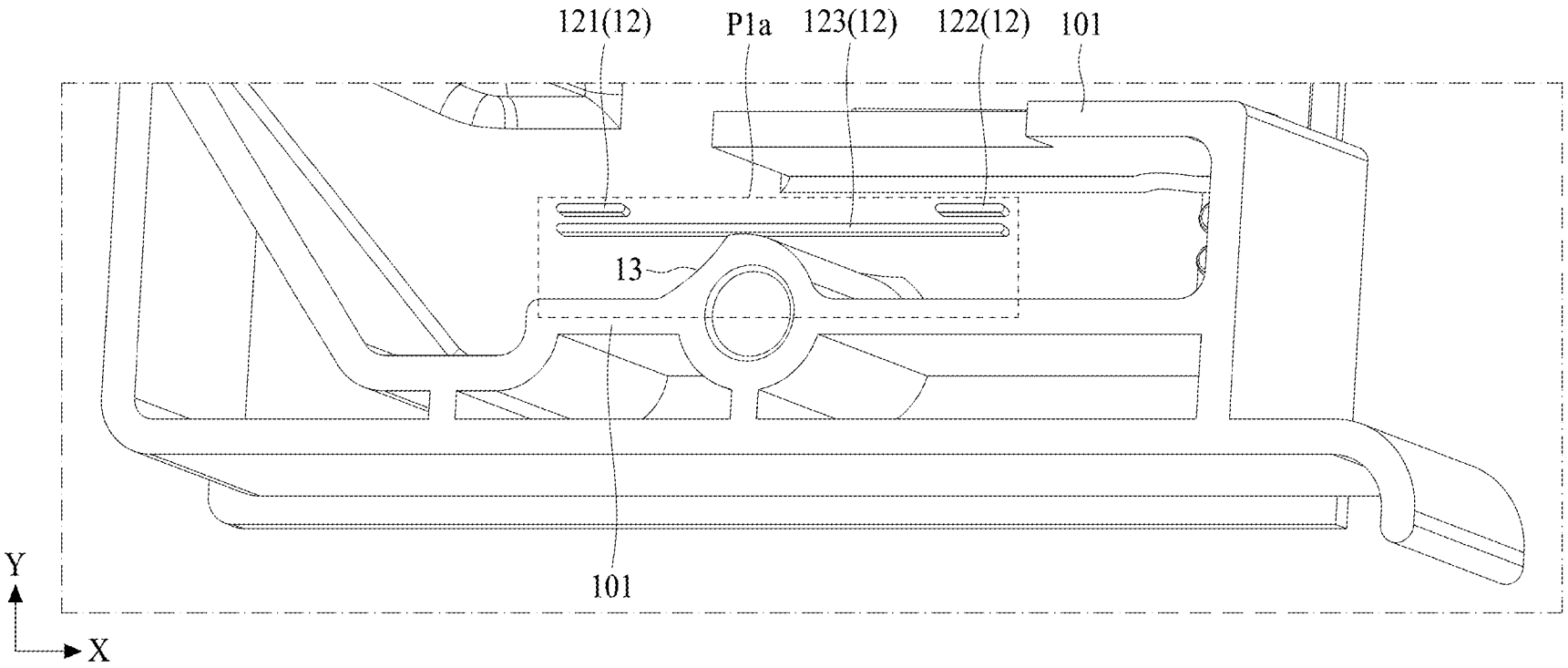

In the embodiment in FIG. 7, the flow guiding member 12 includes the first flow guiding member 121 and the second flow guiding member 122. The first flow guiding member 121 and the second flow guiding member 122 are separated from each other, and all three of the first flow guiding member 121, the second flow guiding member 122 and the structural wall 101 disposed with the obstacle member 13 extend along different directions. In this embodiment, the structural wall 101 disposed with the obstacle member 13 extends along the X direction, an angle θ21 of an acute angle formed between the extension line of the first flow guiding member 121 and the structural wall 101 ranges between 0 and 60 degrees, and an angle θ22 of an acute angle formed between the extension line of the second flow guiding member 122 and the structural wall 101 similarly ranges between 0 and 60 degrees, wherein the angle θ21 and the angle θ22 can be the same or different. In other embodiments, the structural wall 101 does not necessarily extend along the X direction, with however the angle formed between the flow guiding member 12 and the flow direction of the specimen still ranging between 0 and 60 degrees.

The flow guiding member 12 in the embodiments shown in FIG. 4 to FIG. 7 can be combined or substituted according to different requirements. In the embodiment shown in FIG. 8, the flow guiding member 12 includes a first flow guiding member 121, a second flow guiding member 122 and a third flow guiding member 123. In this embodiment, the length of the first flow guiding member 121 and the length of the second flow guiding member 122 are substantially the same, and the length of the third flow guiding member 123 is greater than the length of the first flow guiding member 121 and also greater than the length of the second flow guiding member 122. The flow guiding member 12 in this embodiment is similar to those in the embodiments shown in FIG. 4 and FIG. 5, and further description is omitted herein.

Figure 9:
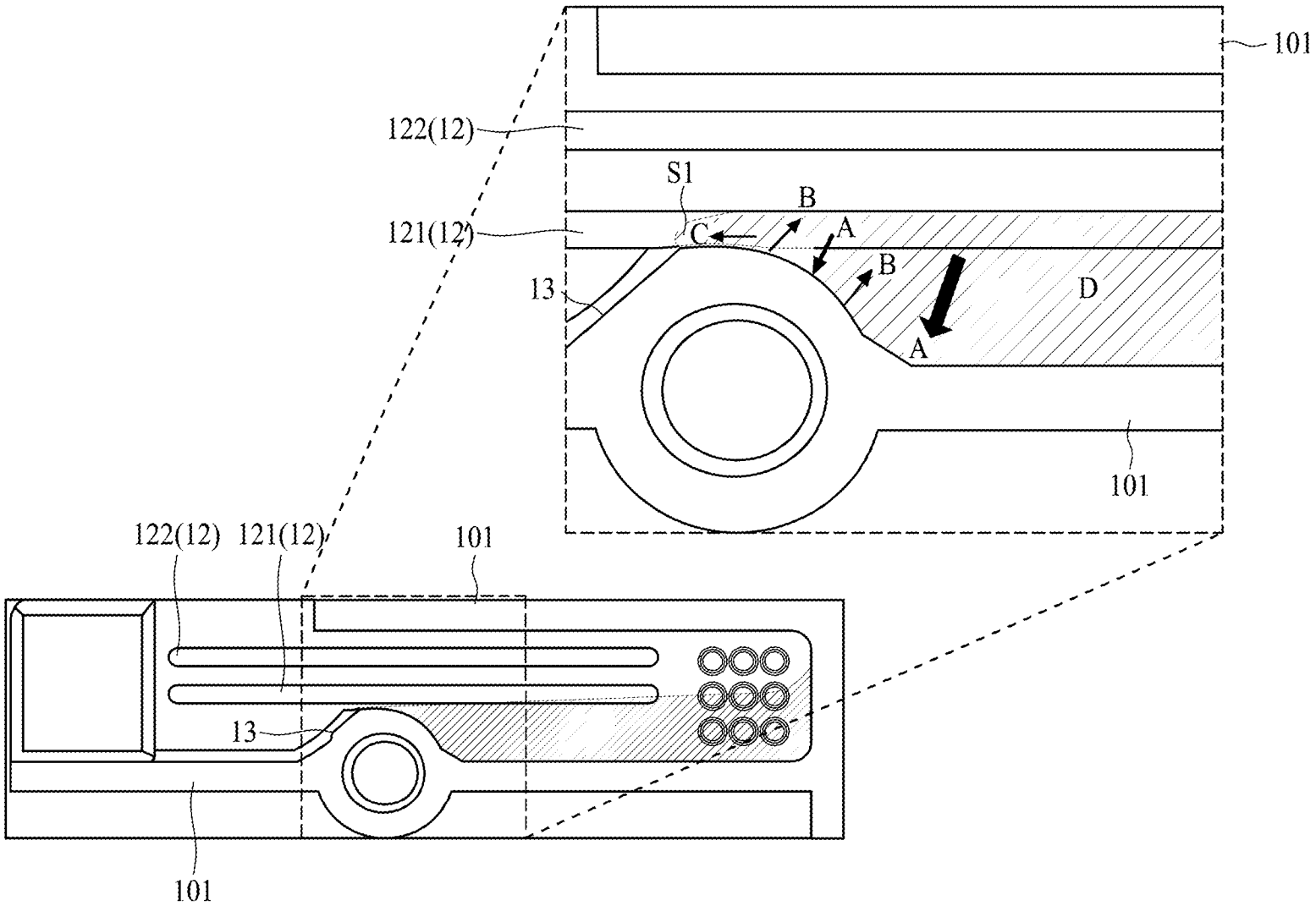
FIG. 9 to FIG. 11 are schematic diagrams of the action of a specimen in a channel region when a reaction cassette is at different rotation angles depicted according to some embodiments of the present disclosure.
Figure 10:
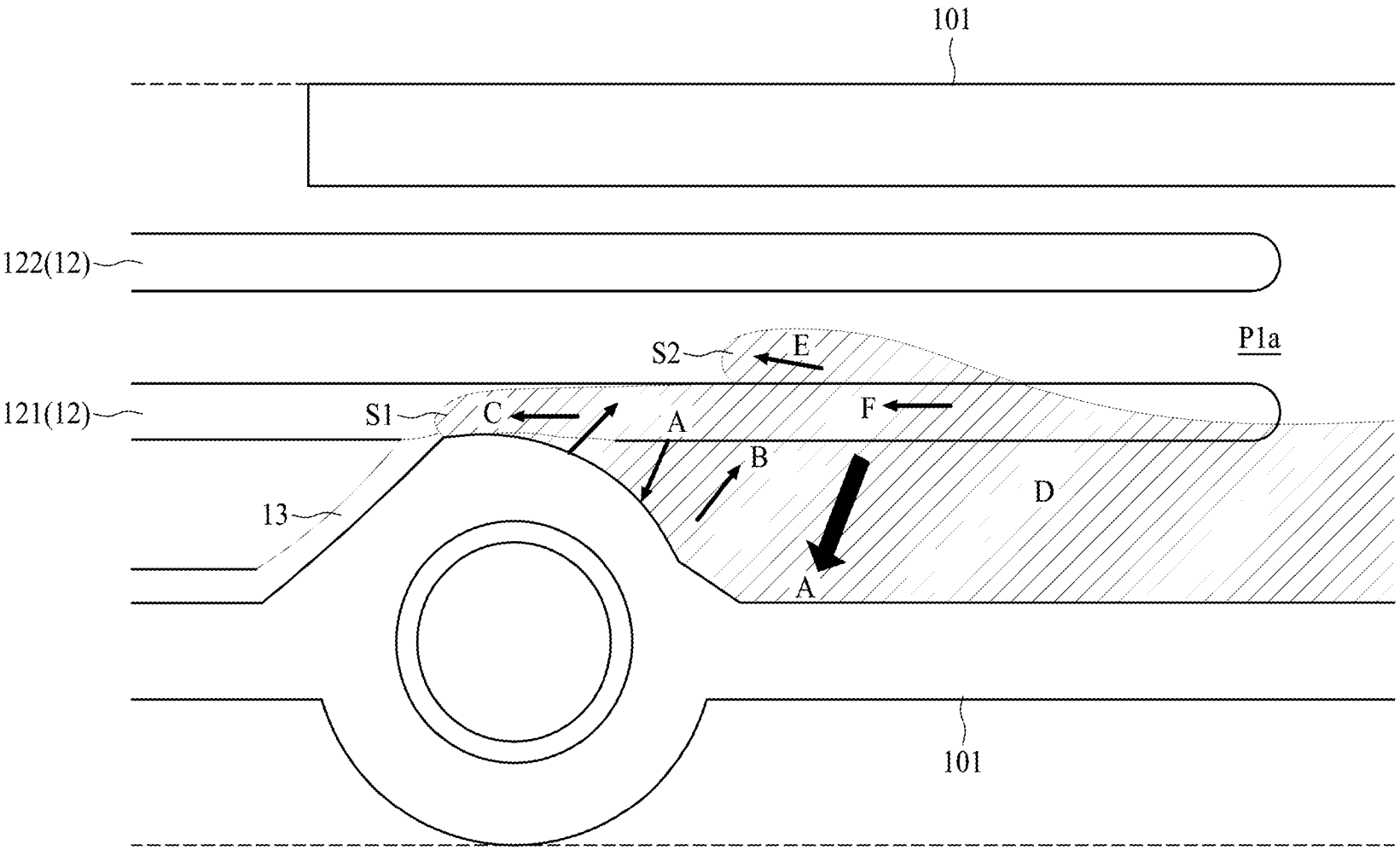
Figure 11:
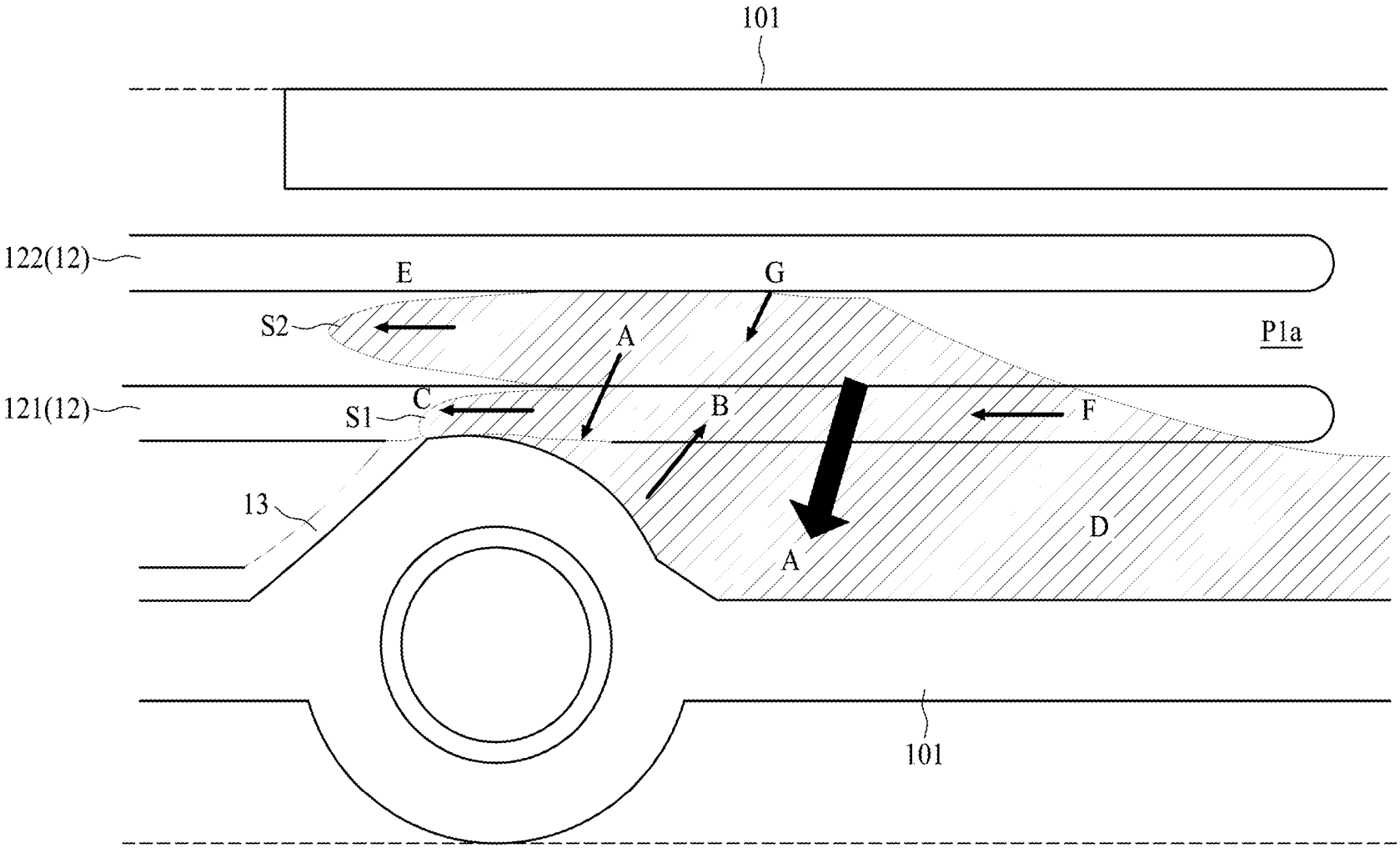
Figure 12:
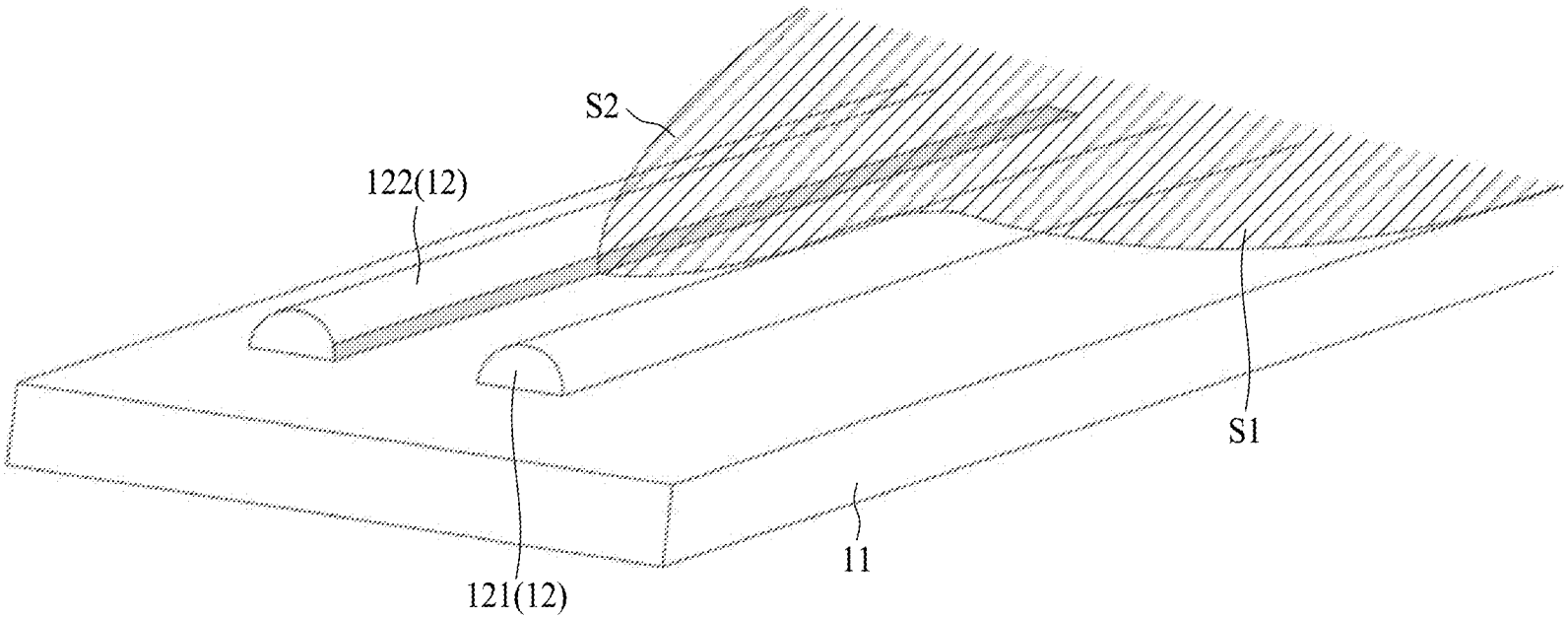
FIG. 12 is a top schematic diagram of the action of the specimen. depicted according to FIG. 11.

FIG. 9 to FIG. 11 and FIG. 13 show schematic diagrams of a specimen flowing in the first channel region P1*a* depicted according to some embodiments of the present invention, and FIG. 12 shows a top schematic diagram of flowing of a specimen depicted according to FIG. 11. For illustration purposes, in FIG. 9 to FIG. 11 and FIG. 13, the structures of the structural wall 101, the obstacle member 13 and the flow guiding member 12 shown in FIG. 2 and FIG. 3 are used for illustration; however, the present invention is not limited thereto.

FIG. 9 shows a schematic diagram of a mixing process of a specimen in the first reaction region R1*a* depicted according to some embodiments of the present disclosure, and an enlarged partial schematic diagram of the specimen in nearby regions of the obstacle member 13. As shown in FIG. 9, the specimen flows into the first reaction region R1*a* as a result of rotation of the reaction cassette 10, and a mixing effect of the specimen with a reagent in the reaction cassette 10 is increased by shaking the reaction cassette 10 left and right. To prevent the specimen from overflowing to a non-predetermined region as a result of shaking during the mixing process, the obstacle member 13 provided can limit the specimen within a predetermined region (e.g., the first reaction region R1*a* in FIG. 9). Further, using the slightly protruding structure of the flow guiding member 12, a spoiling effect is provided during the shaking and mixing process of the specimen, thus similarly increasing the mixing effect. Once the processes of dissolving and mixing with the reagent of the specimen are complete, the reaction cassette 10 is gradually placed upright and/or stopped from shaking so as to stabilize the specimen and to provide a chemical reaction time. At this point, the flow guiding member 12 in the first channel region P1*a* provides effect of eliminating the turbulence flow of the specimen and stabilizing the liquid, thus preventing the specimen from attaching in the first channel region P1*a* due to drastic residual fluctuations caused by residual energy. After the mixing process is complete, a measurement device can start causing the reaction cassette 10 to change the angle toward the direction of the detection region R2 and pouring the specimen, such that the specimen flows toward the direction of the detection region R2. At this point, a force field competition is produced between the obstacle member 13 and the specimen. More specifically, the gravity and the structural wall 101 apply a gravity field A upon the specimen, and along with the tilting of the reaction cassette 10, the gravity field applied by the gravity and the structural wall 101 gradually produce a dividing force C and the specimen starts climbing over the obstacle member 13 and forms a first flow peak S1. However, because the combination of the surface tension B applied upon the specimen by the obstacle member 13, the gravity field A and the cohesive force D of the specimen is greater than the dividing force C, the specimen is yet incapable of crossing over the obstacle member 13.

Next, FIGS. 10 and 11 show schematic diagrams of the reaction cassette 10 in FIG. 9 continuing to rotate such that the specimen flows toward the detection region R2. The tilting angle of the reaction cassette 10 continues to increase, as shown in FIG. 10. At this point, because the total of the surface tension B, the gravity field A and the cohesive force D in the specimen is still greater than the dividing force C, the first flow peak S1 is yet incapable of crossing over the obstacle member 13. However, with the increase in the tilting angle, the part of the specimen at the rear half and away from the obstacle member 13 receives a dividing force E of the gravity due to the tilting angle of the reaction cassette 10 and the surface tension F applied by the first flow guiding member 121, and forms a second flow peak S2. Compared to the first flow peak S1, the second flow peak S2 is less affected by the surface tension B, such that the surface tension F and the cohesive force D in the specimen can affect the flow direction of the second peak flow S2 but does hinder the second peak flow S2 from flowing toward the detection region. R2. Thus, the second flow peak S2 becomes larger as the tilting angle of the reaction cassette 10 increases, and flows along a valley formed between the two protruding structures of the first flow guiding member 121 and the second flow guiding member 122 toward the direction of the dividing force E of the gravity field. As the second peak flow S2 come into contact with the second flow guiding member 122, because the second flow guiding member 122 similarly produces a downwardly pressing surface tension G upon the specimen, the flow of the second flow peak S2 toward the direction of the obstacle member 13 is accelerated.

As shown in FIG. 11, the tilting angle of the reaction cassette 10 continues to increase. However, the total of the surface tension B applied by the obstacle member 13 upon the specimen, the gravity field A and the cohesive force D in the specimen is still greater than the dividing force C, the first flow peak S1 is still incapable of crossing over the obstacle member 13. On the other hand, the second flow peak S2 is affected by the surface tension F and the surface tension G applied by the first flow guiding member 121 and the second flow guiding member 122, and the first flow guiding member 121 and the second flow guiding member 122 are slightly protruding structures, the gravity applied thereby upon the specimen is far less than that by the obstacle member 13. Further, although the first flow peak S1 cannot cross over the obstacle member 13 under such rotation angle, the first flow peak S1 can isolate the surface tension B applied by the obstacle member 13 for the second flow peak S2, and thus the second flow peak S2 can more easily cross over the obstacle member 13 compared to the first flow peak S1.

FIG. 12 shows a schematic diagram of a specimen flowing on the first flow guiding member 121 and the second flow guiding member 122 depicted from a different angle according to the embodiment shown in FIG. 11. As shown in FIG. 11, as the rotation angle of the reaction cassette 10 become larger, the second flow peak S2 crosses over the first flow peak S1 and also crosses over the obstacle member 13 (not shown in FIG. 12).

Figure 13:
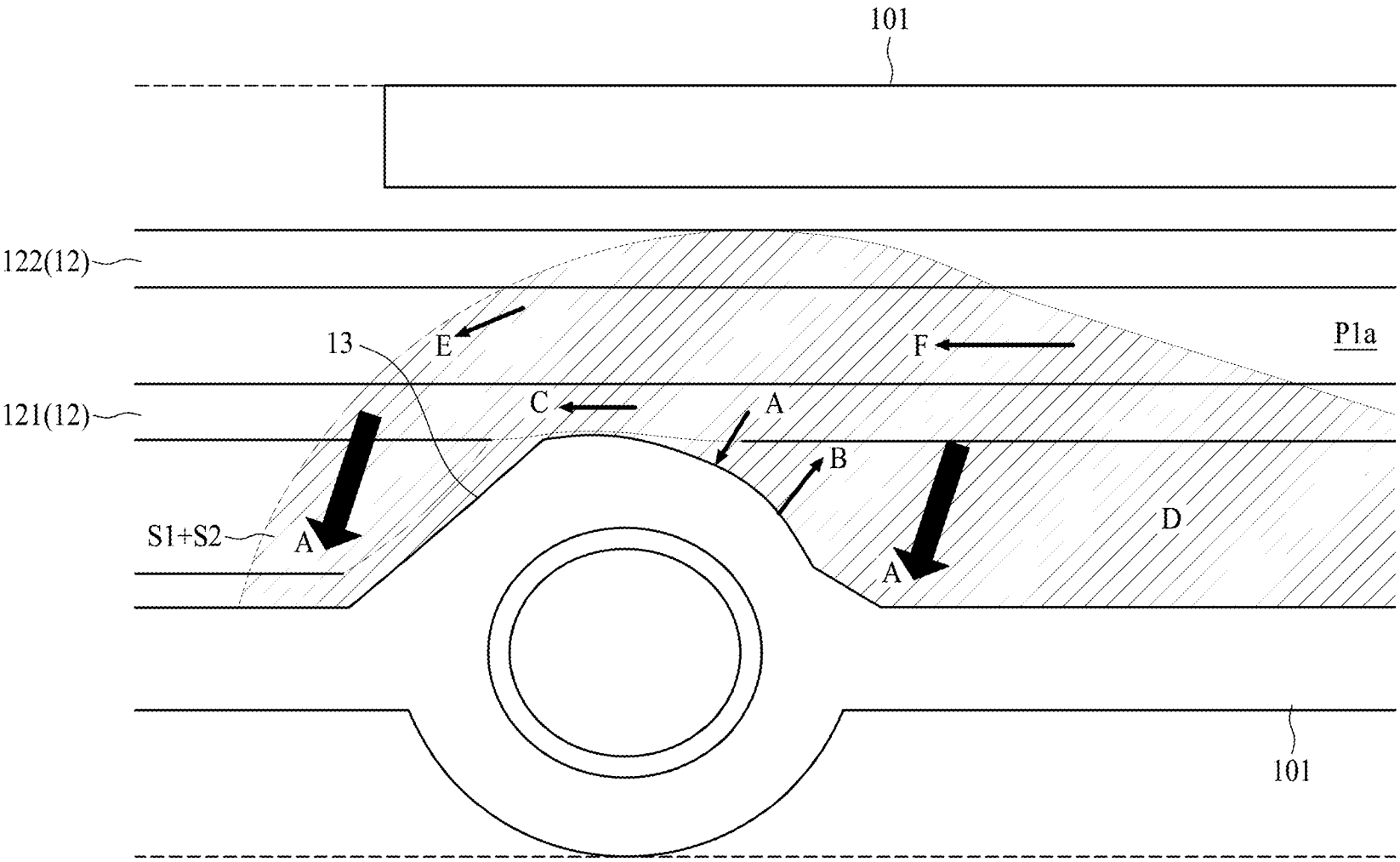
FIG. 13 is a schematic diagrams of the action of a specimen in a channel region when a reaction cassette is at different rotation angles depicted according to some embodiments of the present disclosure.

Then, as shown in FIG. 13, in the lack of the physical support of the first flow peak S1 once the second flow peak S2 crosses over the obstacle member 13 and also under the influence of the gravity field A, the surface tension F applied by the first flow guiding member 121 at this point is smaller than the gravity field A applied by the gravity and the structure upon the specimen, and the influence of the cohesive force D in the specimen is also effective. Thus, the specimen combined with the first flow peak S1 and the second flow peak S2 jointly flow along the wall surface of the obstacle member 13 toward the direction of the gravity field A and further toward one side of the obstacle member 13 close to the detection region R2, until all of the specimen crosses over the obstacle member 13.

Figure 14:
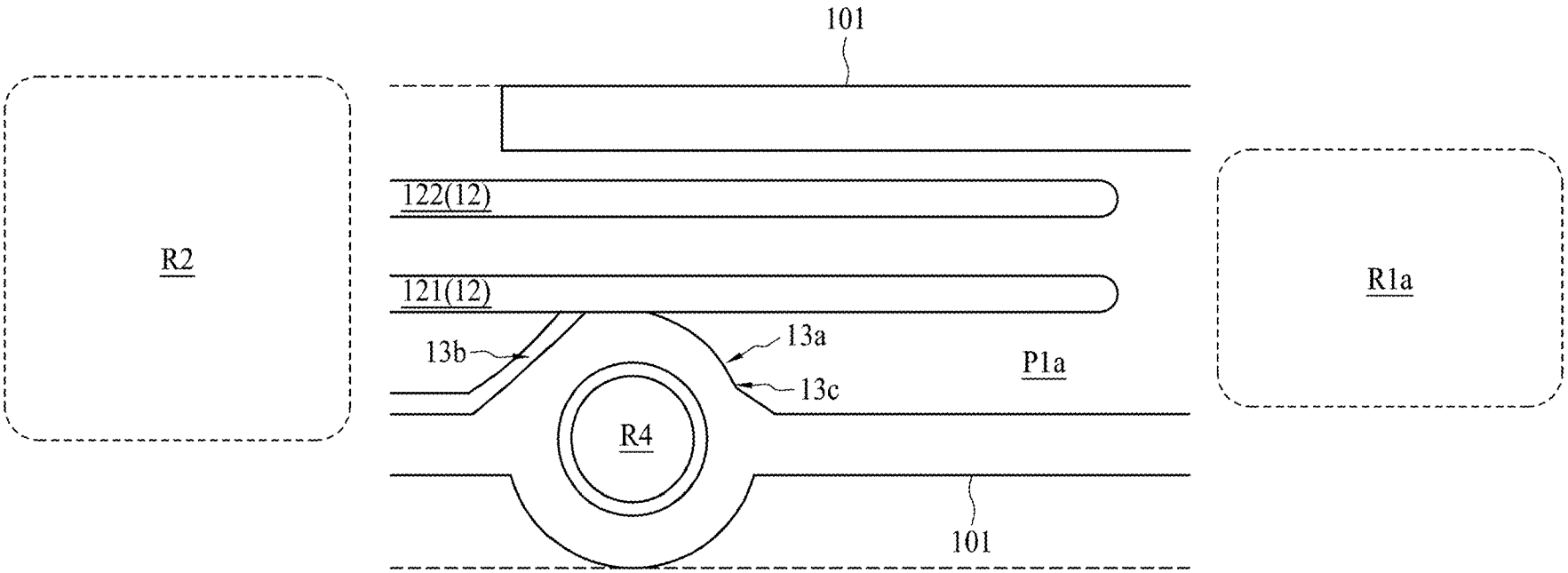
FIG. 14 is an enlarged partial schematic diagram of a channel region when the reaction cassette shown in FIGS. 9 to 11 and 13 is not injected by a specimen.

FIG. 14 shows an enlarged partial schematic diagram of the reaction cassette 10 shown in FIGS. 9 to 11 and FIG. 13 when the first channel region Pa1 is not injected with a specimen. To better facilitate crossing over the obstacle member 13, as shown in FIG. 14, a first part 13*a*, a second part 13*b* and a turning part 13*c* are provided on the surface of the obstacle member 13. The first part 13*a* is close to one side of the first reaction region R1*a* (the right of the obstacle member 13 in FIG. 14), is connected to the structural wall 101 through the turning part 13*c*, and can be configured as a plane, an arc surface or a bent surface. Thus, in the embodiment where the obstacle member 13 is round, despite that the structural wall 101 defines the center of a space R4 by using the obstacle member 13, the angle formed between the obstacle member 13 and the structural wall 101 is also greater than 90 degrees. On the other hand, to better facilitate descending toward the direction of the structural wall 101 after crossing over the obstacle member 13, the second part 13*b* of the surface of the obstacle member 13 is close to one side of the detection region R2 (the left of the obstacle member 13 in FIG. 14), and can be configured as a plane or an arc surface slightly recessed toward the space R4. In other embodiments, the first part 13*a* and the second part 13*b* of the surface of the obstacle member 13 do not include any planes, but are irregular arc surfaces consisted of arcs having different curvatures. In some embodiments, the space R4 defined by the obstacle member 13 can be an assembly slot for assembling the back cover 11*b* and the front cover 11*a*, and is configured to correspond to an assembly bolt (e.g., a cylinder configuration) of the front cover 11*a*. In some embodiments, the space R4 defined by the obstacle member 13 is for accommodating the assembly bolt of the front cover 11*a*; however, the present disclosure is not limited to such example.

Figure 15:
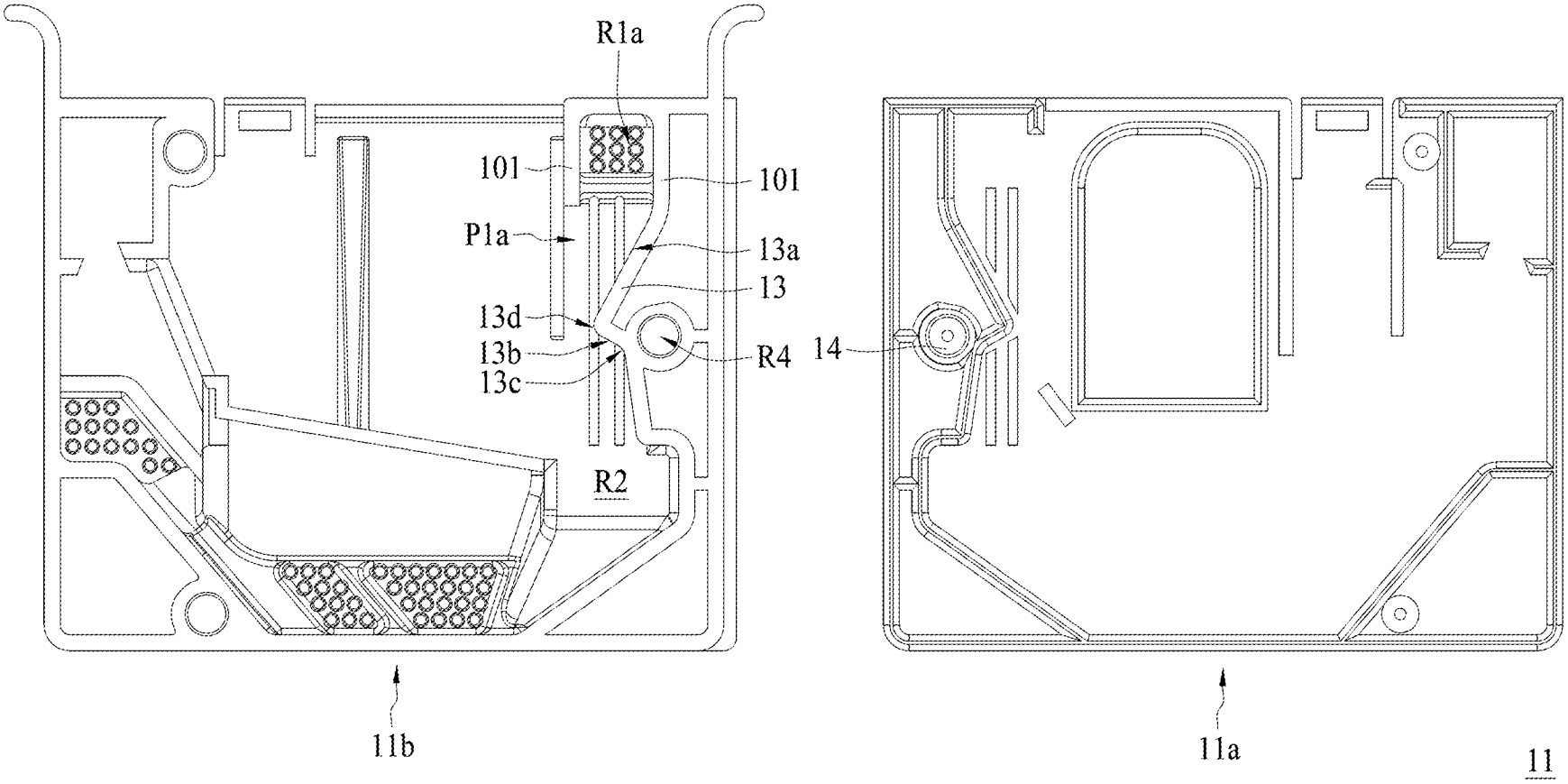
FIG. 15 is a structural schematic diagram of a housing 11 of a reaction cassette depicted according to some embodiments of the present disclosure.

FIG. 15 shows a structural schematic diagram of the front cover 11*a* and the back cover 11*b* of the housing 11 of the reaction cassette 10 depicted according to some embodiments of the present disclosure. In the embodiment shown in FIG. 15, the obstacle member 13 is formed by planes of different slopes, and an assembly slot R4 and the obstacle member 13 are provided separately. The obstacle member 13 has a first part 13*a* close to the surface of the first reaction region R1*a* and a second part 13*b* close to the surface of the detection region R2, and a vertex 13*d* is formed at an intersection of the two. In the embodiment in FIG. 15, the first part 13*a* is an inclined plane having a single slope, the second part 13*b* is formed by combining two inclined planes having different slopes, and a turning part 13*c* is formed at the intersection of the two inclined planes of the second part 13*b*. Further, the assembly slot R4 and the obstacle member 13 can be mutually connected or separated according to different embodiments. For example, in FIG. 15, due to the limitation in the overall space of the reaction cassette 10, the part of the obstacle member 13 close to the detection region R2 is in contact with the sidewall of the assembly slot R4. Thus, in this embodiment, the sidewall of the assembly slot R4 is not used as the obstacle member 13. In this embodiment, the obstacle member 13 and the structural wall 101 jointly define the range of the first channel region P1*a*. Further, in the embodiment in FIG. 15, it is seen that the flow guiding member 12 is disposed on both the front cover 11*a* and the back cover 11*b*. Further, the assembly bolt 14 can be designed to correspond to the assembly slot R4 on the front cover 11*a*. When the front cover 11*a* and the back cover 11*b* are assembled, the assembly bolt 14 (e.g., a cylinder configuration) is placed in the assembly slot R4.

Figure 16:
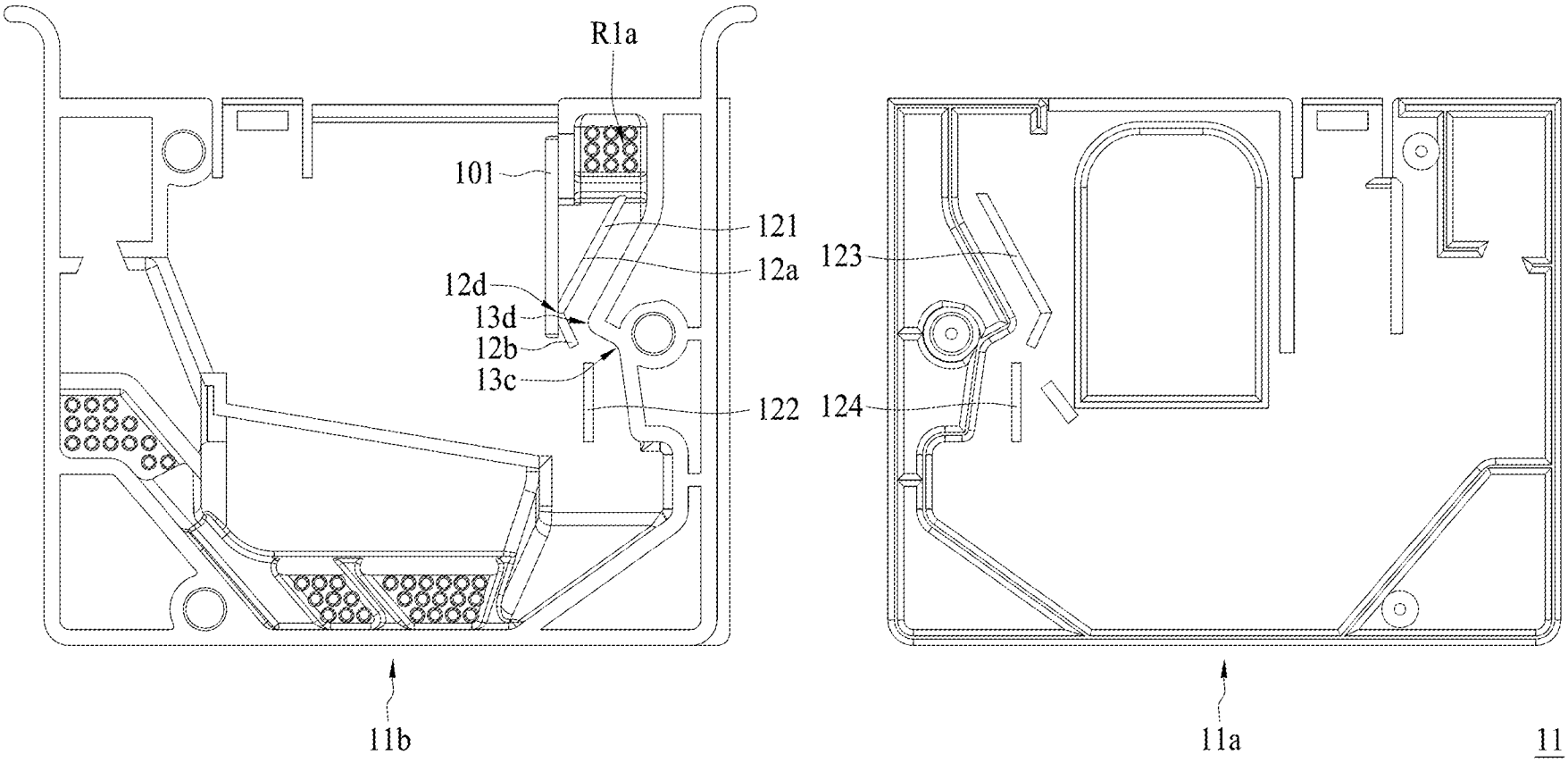
FIG. 16 is a structural schematic diagram of a housing 11 of a reaction cassette depicted according to some embodiments of the present disclosure.

FIG. 16 shows a structural schematic diagram of the front cover 11*a* and the back cover 11*b* of the housing 11 of the reaction cassette 10 depicted according to some embodiments of the present disclosure. The housing 11 shown in FIG. 16 is similar to the housing 11 in FIG. 15; however, the flow guiding member 12 in the embodiment shown in FIG. 16 is not a linear flow guiding member 12 in the embodiment in FIG. 15. Instead, the flow guiding member 12 in the embodiment in FIG. 16 has a similar curvy form as the obstacle member 13. The flow guiding member 12 includes a first flow guiding member 121 and a second flow guiding member 122 provided on the back cover 11*b*, and a third flow guiding member 123 and a fourth guiding member 125 provided on the front cover 11*a*. The first flow guiding member 121 corresponds to the third flow guiding member 123, and the second flow guiding member 122 corresponds to the fourth flow guiding member 125. The first flow guiding member 121 and the second flow guiding member 122 are respectively provided on two opposite sides of the vertex 13*d* of the obstacle member 13, and the first flow guiding member 121 is closer to the first reaction region R1*a* compared to the second flow guiding member 122. The first flow guiding member 121 has a first part 12*a* close to the first reaction region R1*a* and a second part 12*b* close to the detection region R2, and a vertex 12*d* is formed at the intersection of the two to correspond to the vertex 13*d* of the obstacle member 13. The first part 12*a* and the second part 12*b* respectively have different slopes. In the embodiment shown in FIG. 16, the vertex 12*d* of the first flow guiding member 121 is in contact with the structural wall 101. The second flow guiding member 122 is linear in shape, and the extension line thereof does not intersect with the structural wall 101; in other words, the second flow guiding member 122 is parallel to the structural wall 101. In the embodiment in FIG. 16, a space between the first flow guiding member 121 and the second flow guiding member 122 corresponds to the turning part 13*c* of the obstacle member 13; however, the present disclosure is not limited to such example. The third flow guiding member 123 and the fourth flow guiding member 125 have forms respectively corresponding to those of the first flow guiding member 121 and the second flow guiding member 122, and associated description is omitted herein.

Multiple different flow guiding members 12 and obstacle members 13 are provided in the description of the present disclosure above. The obstacle member 13 can help to limit a specimen in the first reaction region R1*a* or the detection region R2, and the flow guiding member 12 can be used to apply a surface tension on the specimen, such that the second flow peak S2 of the specimen can break free from the restraint of the obstacle member 13, which is beneficial for driving the specimen to cross over the obstacle member 13. It should be noted that, the forms of the flow guiding member 12 and the obstacle member 13 are not limited by the present disclosure, and can be geometrically adjusted according to the layout of other elements or areas or measurement requirements of reaction cassette 10. For example, the flow guiding member 12 and the obstacle member 13 can respectively be, for example but not limited to, circles, ellipsoids, fans, bows, triangles, trapezoids, rectangles, rhombus, quadrilaterals, kites and polygons in shape.

Therefore, from an aspect of the present disclosure, the present disclosure provides a reaction cassette for biochemical test. The reaction cassette includes a structural wall, a first flow guiding member and an obstacle member. The structural wall defines a reaction region and a channel region, wherein the reaction region is connected to the channel region. The first flow guiding member is disposed in the channel region, and an angle between the structural wall and the first flow guiding member ranges between 0 and 60 degrees. The obstacle member is disposed on the structural wall, and an angle formed between the obstacle member and the structural wall is greater than 90 degrees.

From another aspect of the present disclosure, an assay device for biochemical test is provided. The assay device includes: a reaction cassette, a storage member and a sampling member. The reaction cassette includes a housing; a structural wall, disposed in the housing, defining a reaction region and a channel region, the reaction region being connected to the channel region, the channel region extending along a first direction; a flow guiding member, disposed in the channel region; and an obstacle member, disposed on the structural wall and protruding toward a direction of the channel region. The storage member is configured to assemble with the reaction cassette so as to enable a specimen to flow into the reaction cassette to undergo reaction. The sampling member is configured to assemble with the reaction cassette to absorb the specimen having undergone reaction.

While the present disclosure and advantages thereof are discussed in detail as above, it should be understood that numerous variations, substitutions and replacements can be made without departing from the spirit and scope of the present disclosure as defined by the appended claims. Further, the scope of the present application is not limited to specific embodiments of manufacturing processes, mechanics, fabrication, substance composition, means, methods and steps. On the basis of the disclosed contents of the present disclosure, a person skilled in the art can understand that, existing or future-developed manufacturing processes, mechanics, fabrication, substance composition, means, methods and steps corresponding to the embodiments of the disclosure and having the same functions or achieving substantially the same results can be used according to the present disclosure, and such manufacturing processes, mechanics, fabrication, substance composition, means, methods and steps are to be encompassed within the scope of the present application.

What is claimed is:

1. A reaction cassette for biochemical test, comprising:

a structural wall, defining a reaction region and a channel region, the reaction region being connected to the channel region;

a first flow guiding member, disposed in and extending along the channel region, wherein an angle between the structural wall and the first flow guiding member ranges between 0 and 80 degrees; and an obstacle member, disposed on the structural wall, wherein an angle between the obstacle member and the structural wall is greater than 90 degrees, wherein the obstacle member protrudes toward the first flow guiding member and the channel region.

2. The reaction cassette according to claim 1, wherein the first flow guiding member and the obstacle member are spaced by a vertical distance.

3. The reaction cassette according to claim 2, wherein the vertical distance ranges between 0.1 and 4 mm.

4. The reaction cassette according to claim 1, wherein the first flow guiding member and the structural wall are separated.

5. The reaction cassette according to claim 1, wherein a length of the first flow guiding member is greater than 4 mm and less than a length of the channel region.

6. The reaction cassette according to claim 1, further comprising:

a second flow guiding member, disposed in the channel region, wherein an angle between the structural wall and the second flow guiding member ranges between 0 and 80 degrees.

7. The reaction cassette according to claim 6, wherein the second flow guiding member and the first flow guiding member are separated, and an extension direction of the second flow guiding member is different from an extension direction of the first flow guiding member.

8. The reaction cassette according to claim 6, wherein the second flow guiding member and the first flow guiding member are separated and parallel to each other.

9. An assay device for biochemical test, comprising:

a reaction cassette, comprising:

a housing;

a structural wall, disposed in the housing, defining a reaction region and a channel region, the reaction region being connected to the channel region, the channel region extending along a first direction;

a flow guiding member, disposed in the channel region and extending along the first direction; and an obstacle member, disposed on the structural wall and protruding toward the first guiding member and the channel region;

a storage member, configured to assemble with the reaction cassette so as to enable a specimen to flow into the reaction cassette to undergo a reaction; and a sampling member, configured to assemble with the reaction cassette to absorb a reacted specimen.

10. The assay device according to claim 9, wherein the housing is square in shape, and the first direction is parallel to a side of the housing.

11. The assay device according to claim 9, wherein the flow guiding member is a protruding structure protruding from the housing toward the channel region.

12. The assay device according to claim 9, wherein the flow guiding member is a groove structure recessed from a surface of the housing facing the channel region.

13. The assay device according to claim 9, wherein the housing comprises a front cover and a back cover, and the flow guiding member comprises a first part on the front cover and a second part on the back cover.

14. The assay device according to claim 13, wherein the first part and the second part are opposite to each other, and a gap is formed between the first part and the second part for the specimen to flow through.

15. The assay device according to claim 13, wherein the structural wall is parallel to one side of the housing, and the obstacle member is disposed on the back cover and is configured to define an assembly slot corresponding to an assembly bolt of the front cover.

* * * * *